US006112941A

United States Patent [19]

Wenner

[11] Patent Number: 6,112,941

[45] Date of Patent: Sep. 5, 2000

[54] SINGLE VEND NEWSPAPER VENDING MACHINE

[76] Inventor: Hans Wenner, Im Eichwald 12, D-69126 Heidelberg, Germany

[21] Appl. No.: 08/976,297

[22] Filed: Nov. 21, 1997

Related U.S. Application Data

[63] Continuation-in-part of application No. 08/828,320, Mar. 28, 1997.

[51] Int. Cl.[7] ..... B25H 3/00

[52] U.S. Cl. ..... 221/213; 221/226; 221/230; 221/244

[58] Field of Search ..... 221/213, 215, 221/226, 230, 244, 56

[56] References Cited

U.S. PATENT DOCUMENTS

| | | | |
|---|---|---|---|
| 1,708,234 | 4/1929 | Nelson | 221/213 |
| 1,982,999 | 12/1934 | Miller | 221/213 |
| 2,195,305 | 3/1940 | Heaton | 221/213 |
| 2,281,191 | 4/1942 | Eddy et al. | 221/226 |
| 2,832,507 | 4/1958 | Beatty | 221/244 |
| 2,926,814 | 3/1960 | Utiger | 221/213 |
| 2,959,264 | 11/1960 | Janson | 221/213 |
| 2,992,756 | 7/1961 | Ray | 221/213 |
| 3,263,859 | 8/1966 | Searle | 221/213 |
| 3,463,356 | 8/1969 | Gatti | 221/213 |
| 3,708,087 | 1/1973 | Schonthal | 221/244 |
| 3,747,733 | 7/1973 | Knickerbocker | 221/244 |
| 4,043,484 | 8/1977 | Vanjo | 221/213 |
| 4,139,120 | 2/1979 | Moore | 221/213 |
| 4,273,256 | 6/1981 | Wenner | 221/230 |
| 4,389,000 | 6/1983 | Godley et al. | 221/226 |
| 4,440,313 | 4/1984 | Krassnig | 221/213 |
| 4,473,172 | 9/1984 | Reynolds | 221/213 |
| 4,566,581 | 1/1986 | Martin | 221/244 |
| 4,770,321 | 9/1988 | Anderson | 221/244 |
| 5,137,134 | 8/1992 | La Spina et al. | 221/213 |
| 5,492,213 | 2/1996 | Kim | 221/244 |

*Primary Examiner*—Christopher P. Ellis
*Assistant Examiner*—Khoi H. Tran
*Attorney, Agent, or Firm*—Brown & Wood, LLP

[57] ABSTRACT

A machine for vending printed products, in particular, newspaper and including a housing for storing the printed products, a coin mechanism associated with the housing for receiving payment for a printed product, and a delivery mechanism for delivery a paid-for printed product to a delivery slot provided in the housing. The delivery mechanism includes a transporting plate for printed products and a lift mechanism for lifting the transporting plate to a printed product delivery position. The delivery mechanism further includes an element which cooperates with the lift mechanism for automatically adjusting the height by which the transporting plate is lifted after the topmost product has been dispensed.

15 Claims, 24 Drawing Sheets

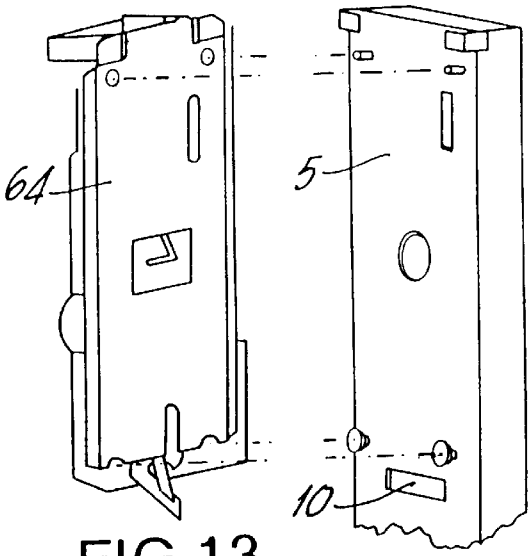
FIG.13
FIG.14
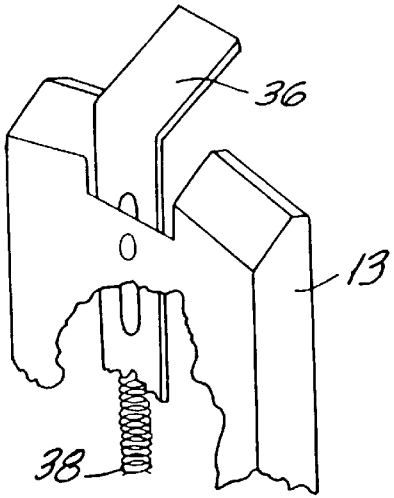
FIG.12
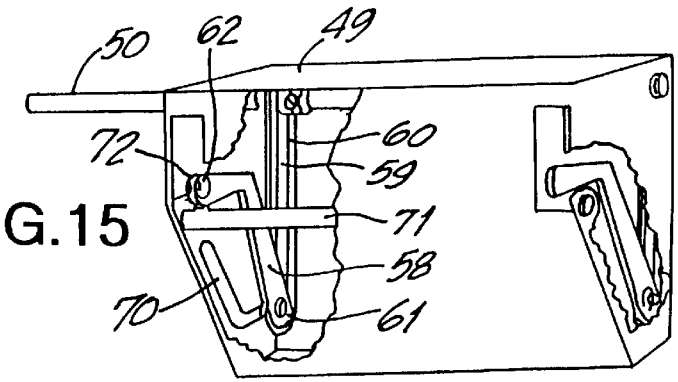
FIG.15
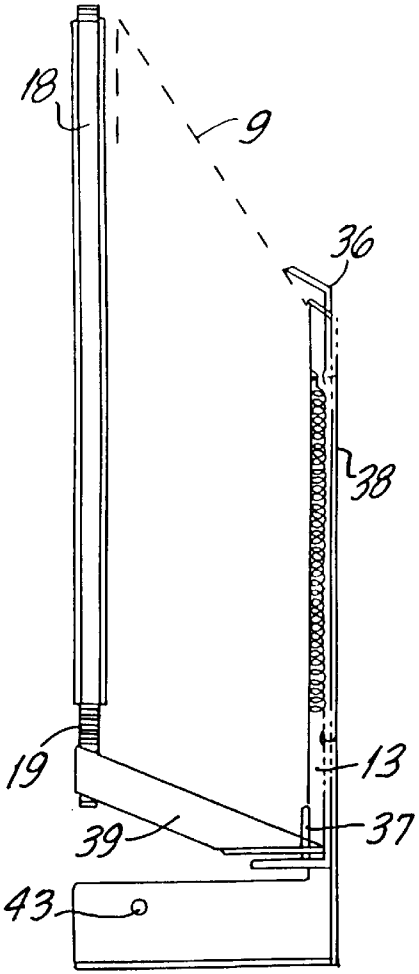
FIG.11

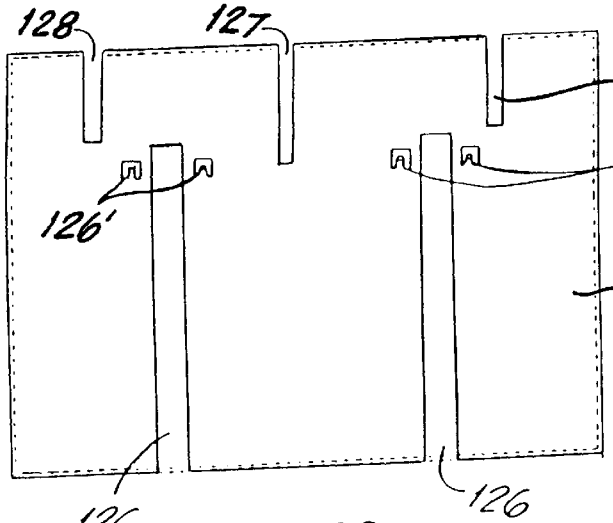
FIG.60
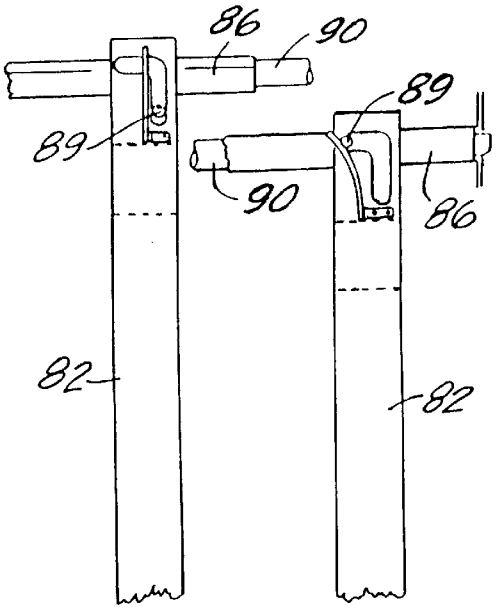
FIG.62b
FIG.62a
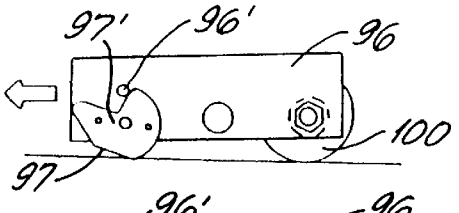
FIG.61a
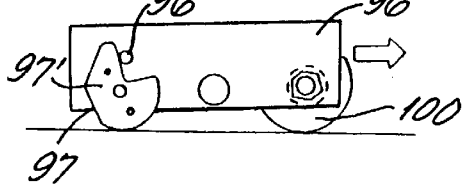
FIG.61b
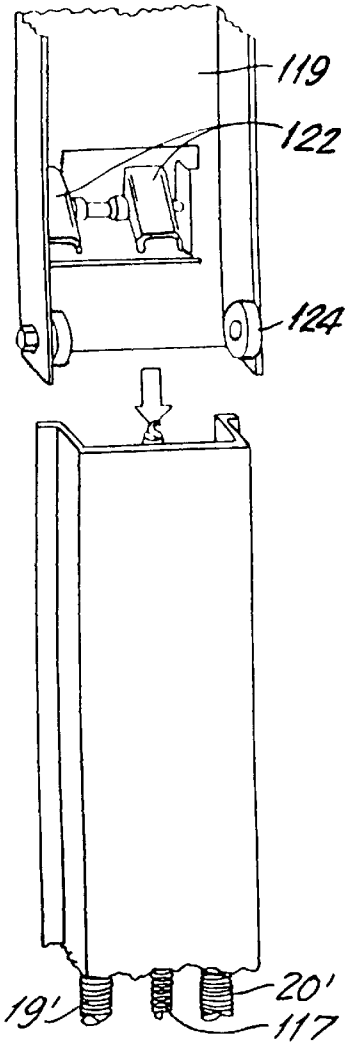
FIG.59

SINGLE VEND NEWSPAPER VENDING MACHINE

RELATED APPLICATIONS

This application is a continuation-in-part of application Ser. No. 08/828,320, filed Mar. 28, 1997 and entitled Single Vend Newspaper Vending Machine.

BACKGROUND OF THE INVENTION

1. Field of the Invention

The present invention relates to a machine for vending printed products, in particular newspapers, and including a housing for storing printed products, an automatic coin mechanism arranged on the housing, and a delivery mechanism for delivering sold printed products to a delivery slot formed in the housing.

2. Description of the Prior Art

A machine of the above-described type is disclosed in U.S. Pat. No. 4,273,256. The machine described in this patent provides for delivery, after insertion of appropriate coins, of a single copy of folded or stitched printed products, with the delivery of the single copy to the delivery slot by a rotating device. The housing of the machine described in U.S. Pat. No. 4,273,256 is so formed that its base surface, which extends horizontally, is capable to receive thereon a stack of printed products to be sold. The necessary dimensions required by this type of machine make it particularly suited for being formed as a footed unit.

However, sometimes, locations having a reduced space available for installation of a vending machine require installation of a machine with reduced dimensions. For example, the wall-installed model should have a depth not exceeding 28 cm.

Accordingly, an object of the present invention is to provide a machine of the above-described type having reduced dimension.

Another object of the present is to provide a vending machine that indicates the printed product on sale, e.g. newspaper by title and issue date to the customer.

SUMMARY OF THE INVENTION

These and other objects of the present invention, which will become apparent hereinafter, are achieved by providing a vending machine of the above-described type with a delivery mechanism which includes an inclined transporting plate for supporting a stack of printed products at an angle to a horizontal.

Applicant has found out that providing a delivery mechanism with an inclined transporting plate permits to reduce the machine dimensions, in particular its depth because with such transporting plate less space is required in the interior of the machine for accommodating a predetermined stack of printed products.

It was further determined that a convenient delivery of the printed products to the delivery slot can be achieved when the transporting plate is so arranged in the housing that its end facing the front side of the housing is spaced from the housing bottom a distance which is less than a distance by which the opposite end of the transporting plate, facing the rear side of the housing, is spaced from the housing bottom. This insures a free access to the topmost printed product of the stack which provides for easy installation of other elements of the delivery mechanism.

Optimally, the inclination angle of the transporting plate to the housing bottom amounts to about 60°. Such angle insures a reliable support of the stack, without a need to use expensive retaining means for preventing sliding of the printed products, which otherwise would have been required if the inclination angle had been greater.

For retaining the stack of printed products, an additional support wall, which would cooperate with the transporting plate for retaining the stack, can be provided in the housing in a spaced relationship to the housing front side. The spaced arrangement of the support wall permits to form somewhat of a conducting channel for delivering printed products to the delivery slot. The support wall can be secured to the housing bottom and extend parallel to the front side of the housing, with the upper end of the support wall being at a level corresponding to the level of the end of the transporting plate facing the front side of the housing.

When a printed product is sold, the height of the stack becomes reduced. Therefore, the delivery of a next printing product to the delivery slot requires a compensation of the lost height of the stack and lifting of the stack to the operational height at which the delivery of a printed product to the delivery opening is effected. To this end, there is provided an operating handle associate with the housing and which is brought into an operational position upon insertion of appropriate coins into the coin mechanism.

The movement of the operating handle is transmitted by a push lever, which is operationally connected with the operating handle, to a displaceable detent rod which is connected with the transporting plate by a pawl. For retaining the transporting plate at a predetermined height, there is provided a second stationary detent rod, which is arranged adjacent to the displaceable detent rod and is connected with the transporting plate by a second pawl. The transporting plate is retained at the predetermined height by engagement of the second pawl with the stationary detent rod, while the displaceable detent rod falls in the direction toward the housing bottom under its own weight upon return movement of the operating handle.

The free fall of the displaceable detent rod can be advantageously controlled by a height regulator, which engages with its upper end the topmost printed product of the stack and the lower end of which is connected with the displaceable detent rod. Thereby, the distance, by which the displaceable detent rod can fall, is measured by or is determined by a distance by which the height regulator itself sinks upon withdrawal of the topmost printed product until its upper end engages the following printed product. As a result, during the next operational sequence, the stack with printed products will be lifted by a distance identical to the previous height loss, so that the now topmost paper is at the necessary operational level. In the inventive vending machine, the height regulation takes place automatically and does not require any adjustment when printed products having different thicknesses are loaded into the vending machine.

The lower end of the height regulator can be bent out for convenient engagement with the displaceable detent rod. Also, the lower end of the displaceable detent rod can be bent out and extend from the rear side of the machine housing toward the housing front side, with the front end being connected to the height regulator, e.g., by a bolt. The connection of the displaceable detent rod with the height regulator can vary dependent, in part, on the height of the housing of the inventive machine.

According to one embodiment of a vending machine according to the present invention, a display window can be provided in the front side of the housing above the delivery slot, in which the next to-be-sold printed product is located, with the title side facing the buyer. The rear wall of the display window may have a sign "sold-out" visible to a buyer in the absence of a printed product in the display window. A microswitch, which is actuated by a displayed printed product, can be also provided in the display window and which, in the absence of a printed product in the display window, blocks the slot of the coin mechanism or connects it with return pocket.

To prevent theft of the printed products, the display window is provided with alternatively opening and closing upper and lower gates which are actuated by movement of the operating handle. The gates can operate as a sluice when one gate becomes open only when the other is closed. For controlling opening and closing of the gates, a control bar, which is actuated by the operating handle, is provided.

For transporting of the topmost printed product to the delivery opening, there is provided at least one push arm. For a uniform delivery, advantageously, two push arms, arranged parallel to each other, are used. The push arms are provided with delivery needle which engage the topmost printed product.

The process of delivery of the topmost printed products starts from the delivery needles penetrating the printed product. Then, the push arm is pivoted upward, disengaging the topmost printed product from the upper end of the height regulator by pushing it toward the end of the transporting plate facing the rear side of the housing. This causes the withdrawal of the topmost printed product from under the upper end of the height regulator which sinks until it engages the following printed product. Upon return movement of the push arm, the needles are disengaged from the printed product, and it slides, under its own weight, due to the inclination of the transporting plate, toward the delivery slot.

In the vending machine provided with the display window, the printed product slides toward the upper gate and, upon opening of the upper gate by operating the operating handle, into the display window. In both types of the inventive vending machine, with and without a display window, the height regulator, upon sinking down, forms a delivery bridge for the printed product, which insures a reliable delivery of the printed product toward the display window or the delivery slot.

Like the upper and lower gates, the push arm can likewise be pivoted between its two position with a control bar actuated by the operating handle. Advantageously, single control bar is used for both operating the gates and moving the push arm or arms.

It should be pointed out that a vending machine with a display window is preferably formed as a wall unit. In a footed unit, because of its lower height in comparison with a wall unit, providing a delivery slot in its lower end would be inconvenient for a buyer. However, transporting a printed product toward the top presents some difficulties. Therefore, in a footed unit, in addition to the outer hinged door with the display window, a second closable inner hinged door with a delivery slot is provided. However, the delivery mechanism for both wall and footed units remains substantially the same.

BRIEF DESCRIPTION OF THE DRAWINGS

The features and objects of the present invention will become more apparent, and the invention itself will be best understood from the following detailed description of the preferred embodiments when read with reference to the accompanying drawings, wherein:

FIG. 11 is a schematic side view of an assembly of newspaper vending machine according to the present invention, which incudes the lift mechanism and a height regulator;

FIG. 12 is a perspective view showing the upper portion of the height regulator and a partially broken away support wall;

FIG. 13 is a schematic perspective view of the coin mechanism of a newspaper vending machine according to the present invention;

FIG. 14 is a schematic perspective view of rear side of a niche formed in the pivotal front door on which the coin mechanism is mounted;

FIG. 15 is a schematic, partially broken away, perspective view of the newspaper push mechanism of a newspaper vending machine according to the present invention;

FIG. 59 is a view showing a guide rail and the sliding carriage;

FIG. 60 is a top view of the transporting plate;

FIG. 61*a* is an elevational view of the rocker in its advancing position;

FIG. 61*b* is a elevational view of the rocker in its returning position;

FIG. 62*a* is a partial elevational view of the operating lever in its non-operative position;

FIG. 62*b* is a view similar to that of FIG. 62*a* but showing the operating lever in a stall position;

DETAILED DESCRIPTION OF THE PREFERRED EMBODIMENTS

Figure 1:
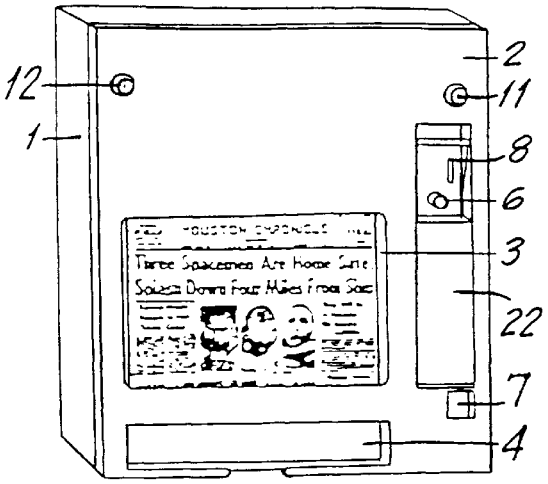
FIG. 1 is a perspective view of a first embodiment of a newspaper vending machine according to the present invention in a non-operated condition.
Figure 2:
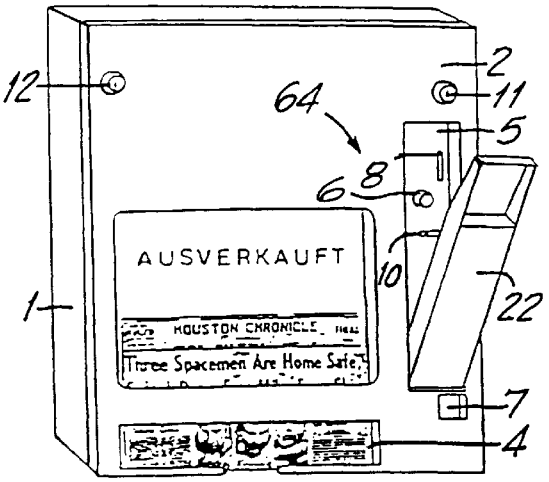
FIG. 2 is a perspective view of a first embodiment of a newspaper vending machine shown in FIG. 1 in an operated condition.
Figure 3:
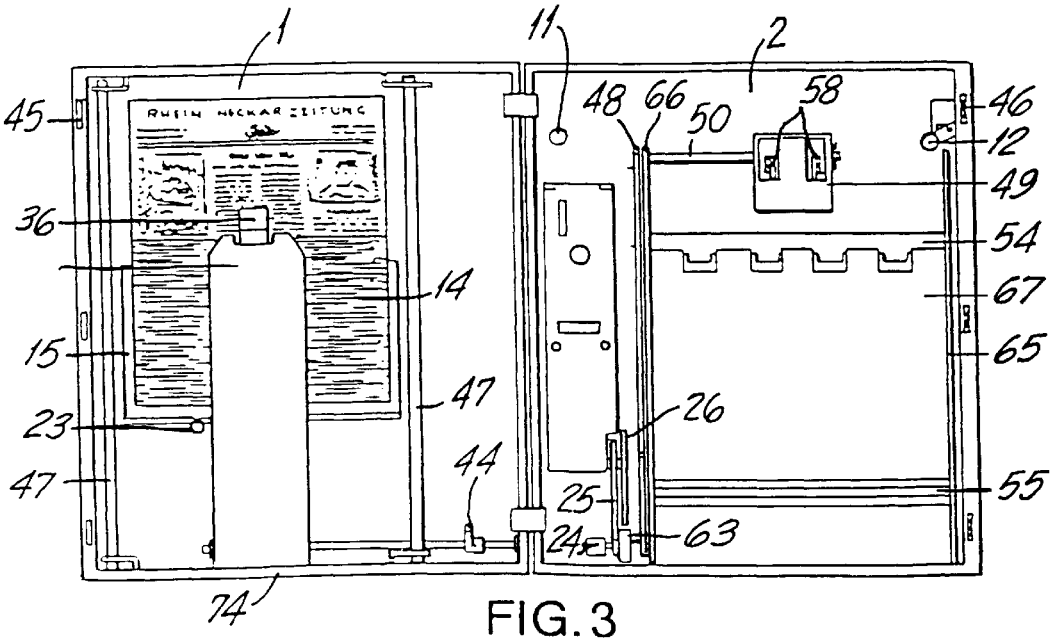
FIG. 3 is a front view of the newspaper vending machine with the pivotal front door of the machine being open.

FIGS. 1–3 show a machine for vending printing products and, in particular, a newspaper vending machine according to the present invention. The newspaper vending machine showing in FIGS. 1–3 includes a housing 1 for storing newspapers and having a hinged front door 2, and a coin mechanism 64 arranged in the housing 1. The machine further includes a transporting mechanism for delivery of the newspapers to a delivery opening 4 in the housing 1.

Figure 10:
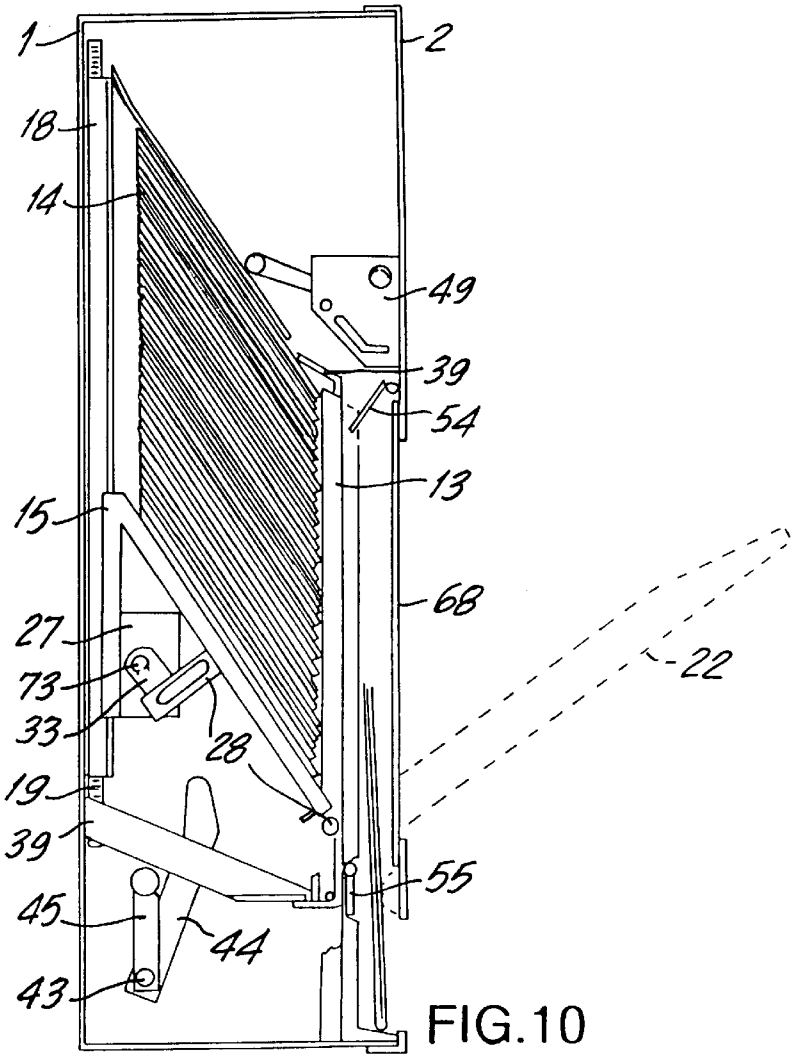
FIG. 10 is a view similar to that of FIG. 9, with the operating handle being pulled out.
Figure 9:
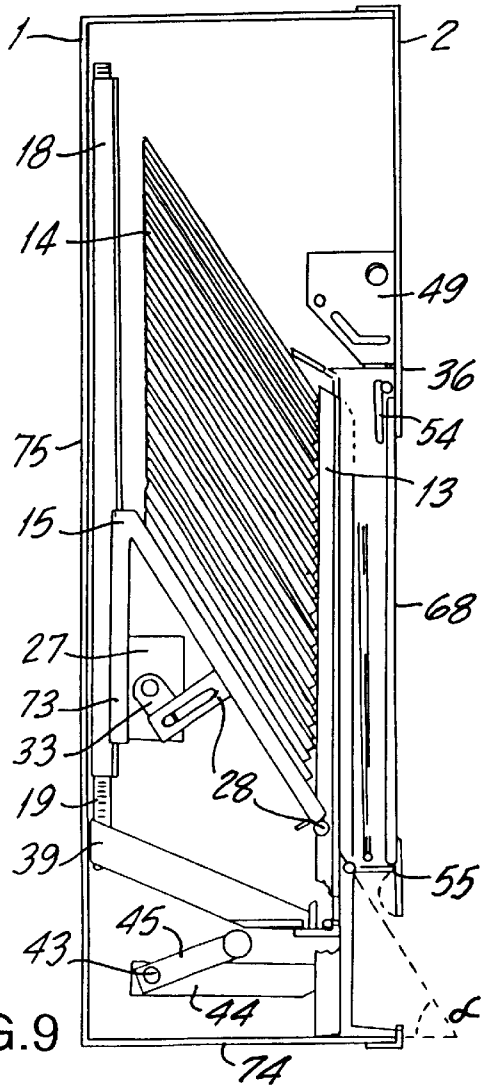
FIG. 9 is a schematic side view of the newspaper vending machine sown in FIG. 1 with the left side wall being removed.
Figure 16:
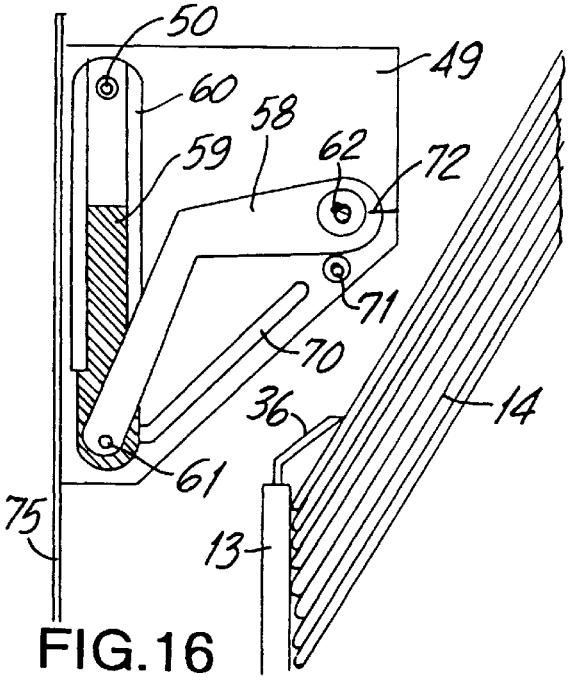
FIG. 16 is a schematic side view of the newspaper push mechanism in its non-operative position.
Figure 17:
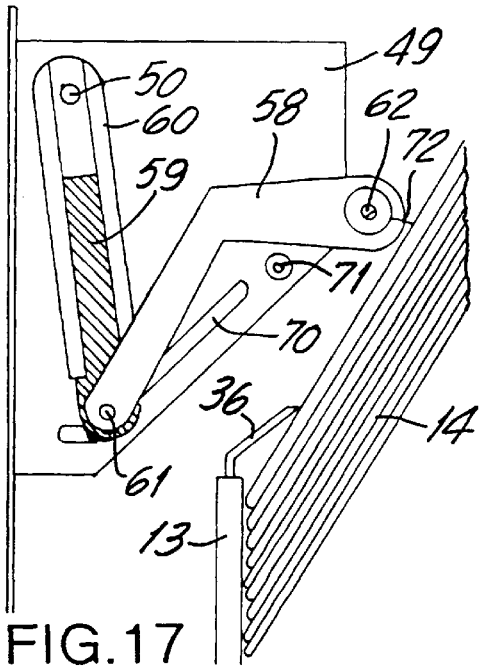
FIG. 17 is a schematic side view similar to that of FIG. 16 showing the push mechanism in an operating position, in which the push arm engages a newspaper.
Figure 18:
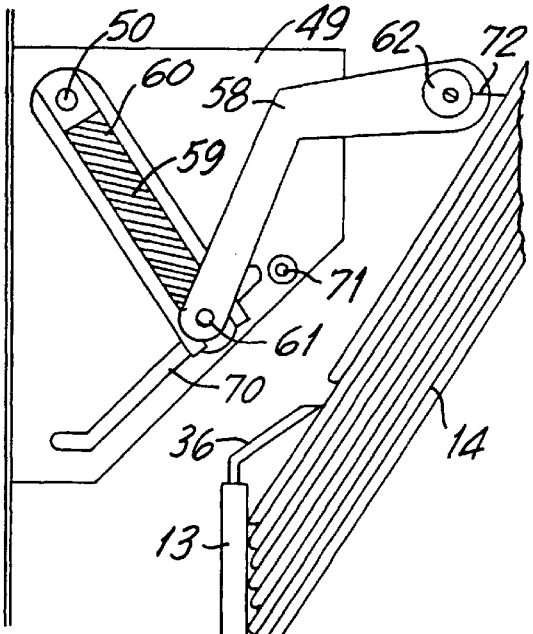
FIG. 18 is a schematic side view similar to that of FIG. 17 with a lifted push arm and with the uppermost newspaper disengaged from the height regulator.
Figure 19:
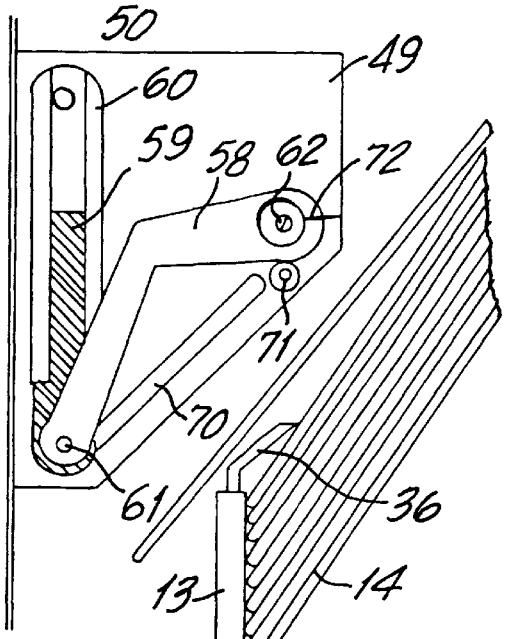
FIG. 19 is a schematic side view similar to those of FIGS. 16–18 showing the push mechanism in its non-operative position with the uppermost newspaper sliding from the transporting plate downward.
Figure 21:
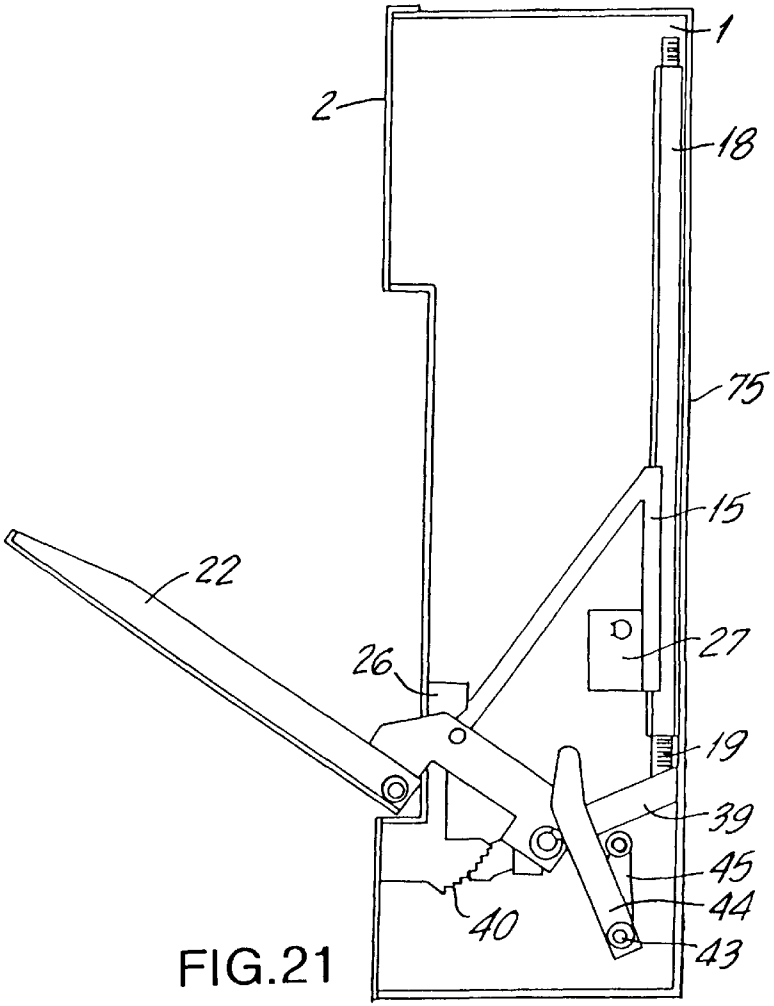
FIG. 21 is a view similar to that of FIG. 20, with the operating handle being pulled out.
Figure 20:
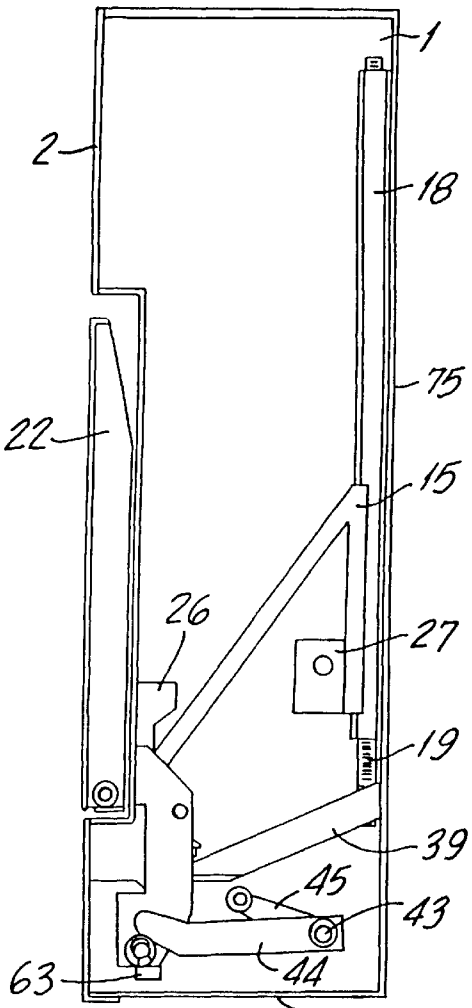
FIG. 20 a schematic side view of the newspaper vending machine showing in FIG. 1 with the right side wall being removed and showing the operating handle, the push lever and lift mechanism.
Figure 23:
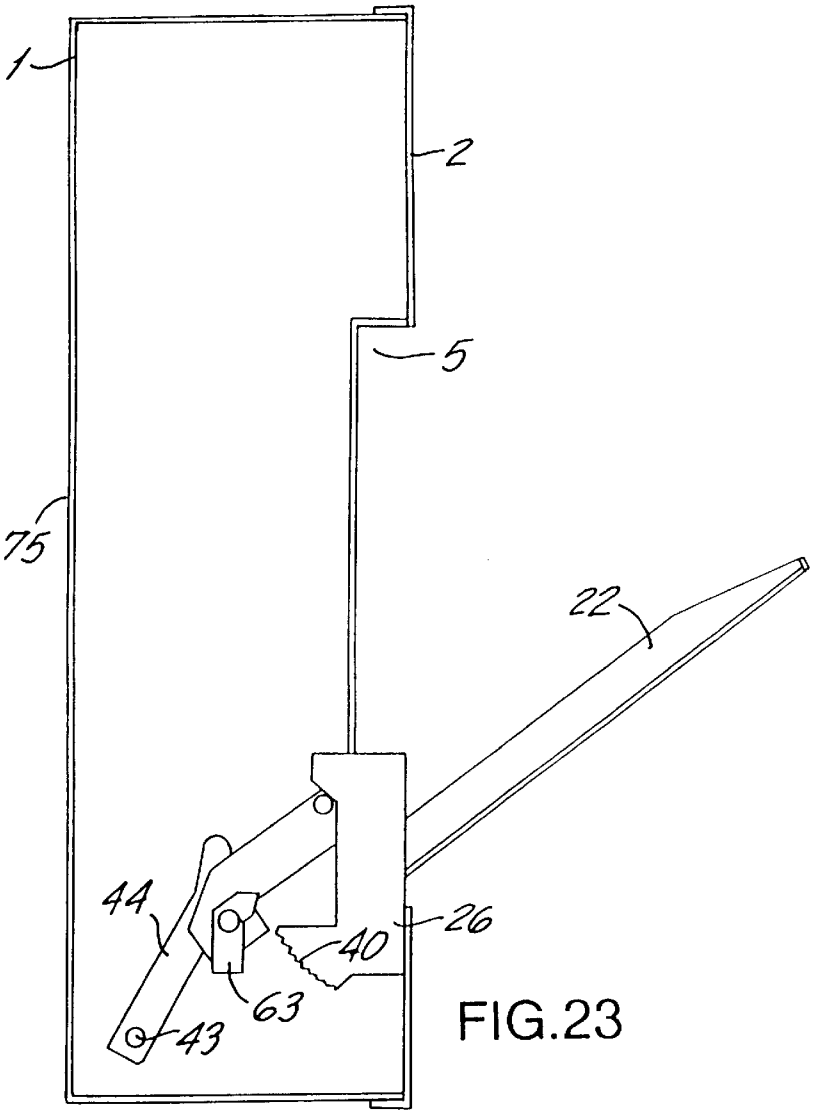
FIG. 23 is a view similar to that of FIG. 22 with the operating handle being pulled out.
Figure 22:
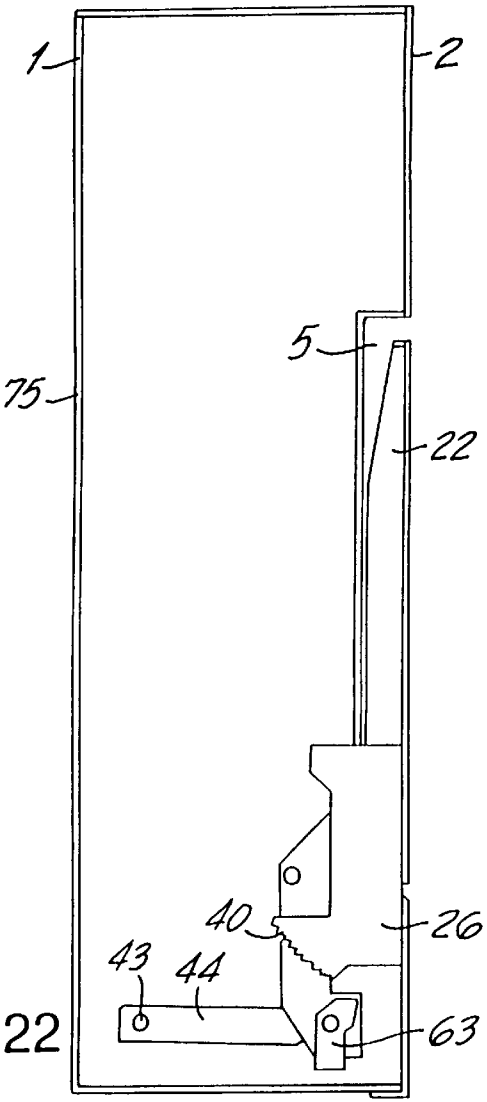
FIG. 22 is a side view of the newspaper vending machine shown in FIG. 1 with the left side wall being removed and showing the assembly including the operating handle, a reverse pawl, a stop, and the push lever.

According to the present invention, the transporting mechanism includes an inclined transporting plate 15 on which a newspaper stack is supported. the transporting plate 15 is shown in details in FIGS. 9–10.

The transporting plate 15 has a newspaper supporting part inclined toward bottom 74 of the housing 1 and somewhat spaced from the bottom 74, and a vertical part spaced from the rear wall 75 of the housing 1. The angle $\alpha$, shown in dash lines, between the inclined part of the transporting plate 15 and the bottom 74 of the housing in the embodiment of the machine shown in the drawings is about 60°.

As further shown in FIGS. 1–3, the hinge front door 2 has a display window 3. A niche 5 for receiving an operating handle 22 is formed in the front hinged door 2. The operating handle 22 cooperates with the transporting plate 15 for lifting the stack of newspapers 14 to a certain operational height g at which the paper is pushed to the delivery opening 4. The operating handle 22, upon actuation of the coin mechanism 64, can be operated from outside and be brought into its operational position.

Figure 30:
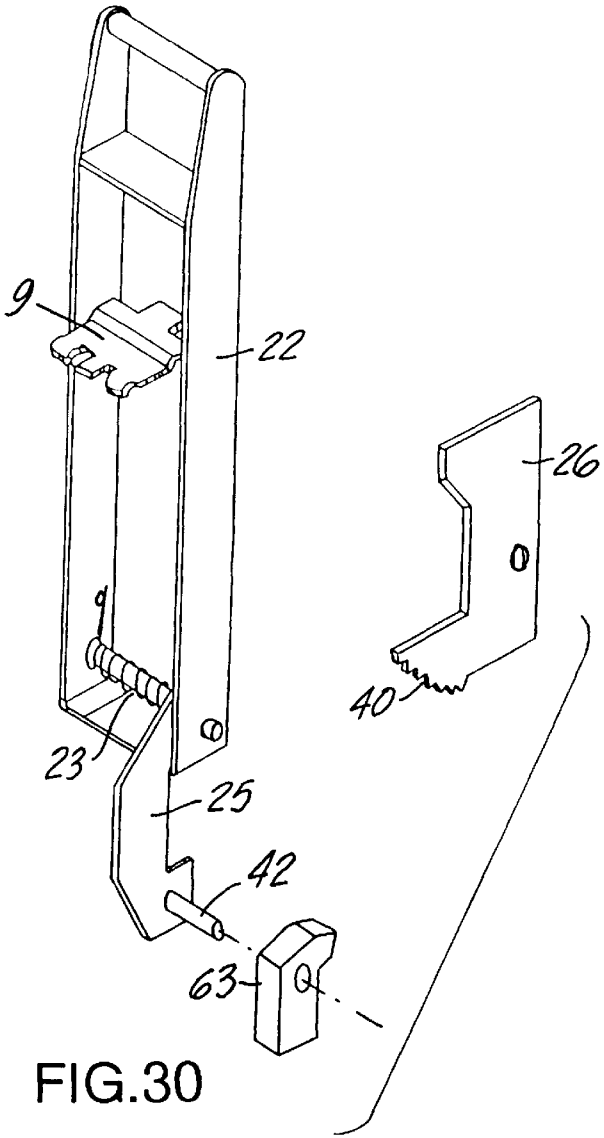
FIG. 30 is a schematic perspective view of an assembly of a newspaper vending machine according to the present invention and including the operating handle, a stop, and a reversing pawl.

Coin return knob 6, coin insertion slot 8, a recess for the locking fishplate (9), which is shown in FIG. 30, and a coin return opening (7) are also provided in the region of the niche. In the upper region of the housing 1, there is provided a safety lock 12 for locking the front hinged door 2. As shown in FIG. 3, there are further provided another door lock 46 and limiting bars 47.

As further shown in FIGS. 9–12, there is provided a support wall 13 which cooperates with the transporting plate 15 to prevent sliding of the newspaper stack on the inclined part of the transporting plate 15.

Figure 5:
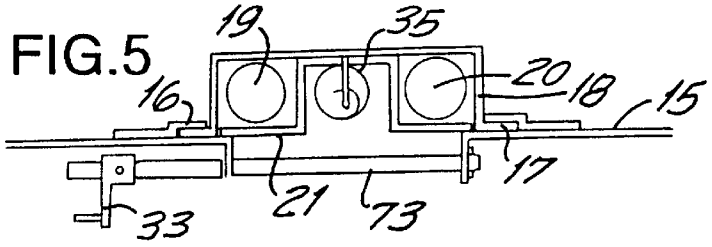
FIG. 5 is a schematic plan view of a subassembly of newspaper vending machine according to the present invention including the lift mechanism with the transporting plate and showing the rear portion of the transporting plate, which is offset with respect to the newspaper supporting portion, with a pawl shaft, but without the pawl.
Figure 4:
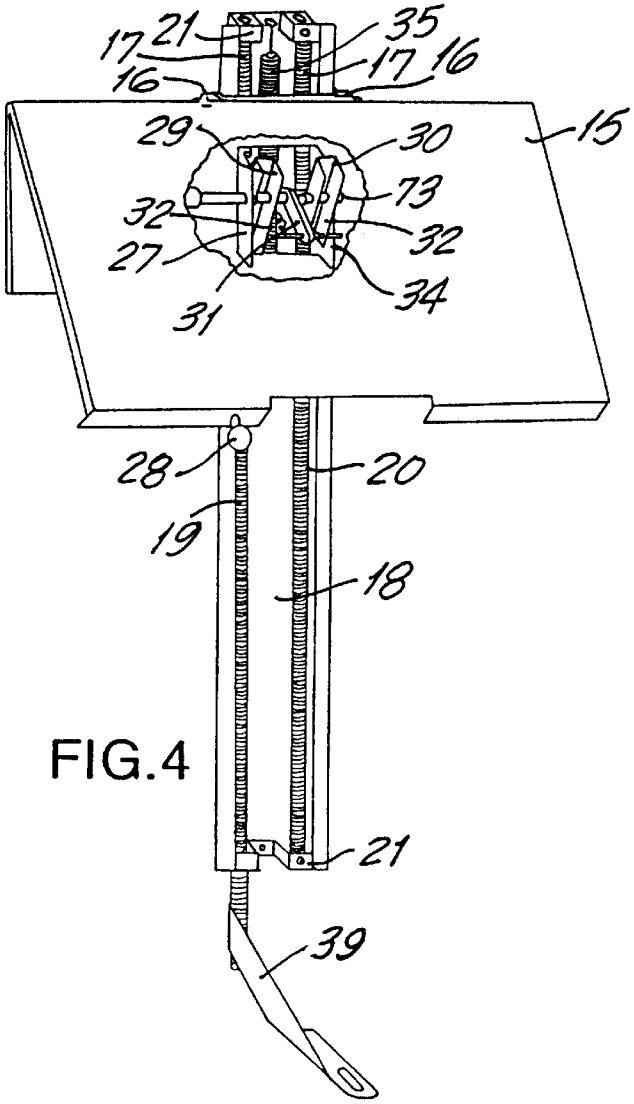
FIG. 4 is a schematic perspective view of a lift mechanism of newspaper vending machine according to the present invention with a partially broken away newspaper transporting plate.

As shown in FIGS. 4–5, the transporting plate 15 is vertically displaced in a guide groove 16 over guide rails 17 provided in the housing 18 of the lift mechanism. The lift mechanism further includes a movable detent rod 19, a stationary detent rod 20, and support means 21 for the detent rods 19, 20. The movable detent rod 19 cooperates with a release spring 35. The lift mechanism is operated with the operating handle 22 which cooperates with a thrust lever formed of a thrust lever shaft 43, a power arm 44 and a work arm 45.

The position of the lift mechanism is determined by the position of the transporting plate 15 which is defined by cooperation of pawls 29 and 30 with the adjacent detent rods 19, 20, which pawls 29 and 30 provide for a stepwise (teeth dependent) lifting of the transporting plate 15 to each level and for retaining the transporting plate 15 at that level. As shown in FIG. 3, a push mechanism 49 for pushing the topmost newspaper and the coin mechanism 64 are arranged on the inner side of the hinged front door 2.

As shown in FIGS. 4, 5, 9, 10, 20 and 21, the two detent rods 19, 20, which extend parallel to each other, are provided in the housing 18 of the lift mechanism. The left detent rod 19, as it was mentioned previously, is movable in a vertical direction, and the right detent rod 20 is stationary. Two pawls 29 and 30 are mounted on the inner side of the rear, offset part of the transporting plate 15. The two pawls 29, 30 are pivotally mounted on a mount 27. The two pawls 29, 30 are engageable to the respective detent rods 19, 20 with both their ends, lower and upper ends. Upward or downward engagement of the pawl 29, 30 with respective detent rods 19 and 20 is controlled by a directional switch 28 via a pawl shaft 33, which cooperates with a shaft 73, for pivoting the pawls 29, 30. The shaft 73 is connected with a rocker 31 which is connected with the pawl 29, 30 via respective tension springs 32.

Figure 6:
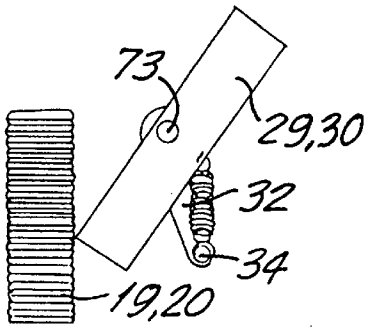
FIG. 6 is a schematic view of the pawl shaft shown in FIG. 4 in its operational condition with respect to a detent rod of the lift mechanism.
Figure 8:
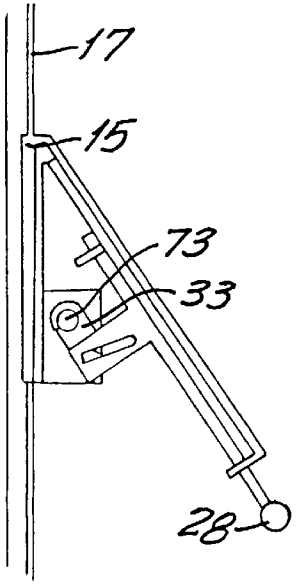
FIG. 8 is a side view showing a mechanism for switching the pawl positions.
Figure 7:
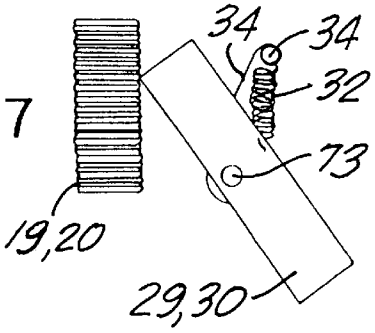
FIG. 7 is a schematic view of the pawl in its "Fill" position with respect to the detent rod.

FIG. 6 shows a position of the pawls 29, 30 necessary for the operation of the vending machine. FIG. 7 shows a position of the pawls 29, 30 in which new newspapers are loaded into the vending machine. During the reversal of the positions of the pawls 29, 30, the rocker crossbar 34 moves the pawls 29, 30 out from their initial position.

The pawl 30, together with the stationary rod 20, provides for retaining of the transporting plate 15 at each level. It engages the detent rod 20 and enables a stepwise displacement (dependent of a distance between the detent teeth of the detent rod) of the transporting plate 15 upward along the entire length of the detent rod 20.

The other pawl 29 engages the displaceable detent rod 19 and pushes, upon its lifting, the transporting plate 15 upward via push lever formed of a lever shaft 43 and power and work arms 44 and 45. The release spring 35 serves for the reduction of load on the pawls 29, 30 from the newspaper stack. With reference to FIGS. 4 and 6–8, the change of the positions of the pawls 29, 30 will now be described. During the loading of new newspapers, both pawls 29, 30 are displaced from their operational position into their loading position. In this position of the pawls 29, 30, the transporting plate 15 is pressed downward to each desired height position against the bias of the release spring 35. The pawls 29, 30 which, in this position, engage the detent rods 19, 20 with their upper ends, prevent the transporting plate 15 from upward movement under the bias of the release spring 35. After the formation of the new newspaper stack, the pawls 29, 30 are again displaced into the operational position, and the transporting plate 15 is pushed upward to a level at which the topmost newspaper is located adjacent to an operations height g. The displacement path is spanned by a multiple lifting of the power arm 44 of the push lever, whereby an exact positioning is possible.

The stepwise displacement of the transporting plate 15 from its downward position upward is effected with the displacing detent rod 19 (please see FIGS. 9, 10, 20, 21). As can be seen, the lower end of the detent rod 19 is located, in accordance with the required height, to a lesser or greater extent in the operational region of the work arm 45 of the push lever, and the detent rod 19 is lifted by the work arm 45 of the push lever to the necessary operational height g during a following operational movement.

Figure 29:
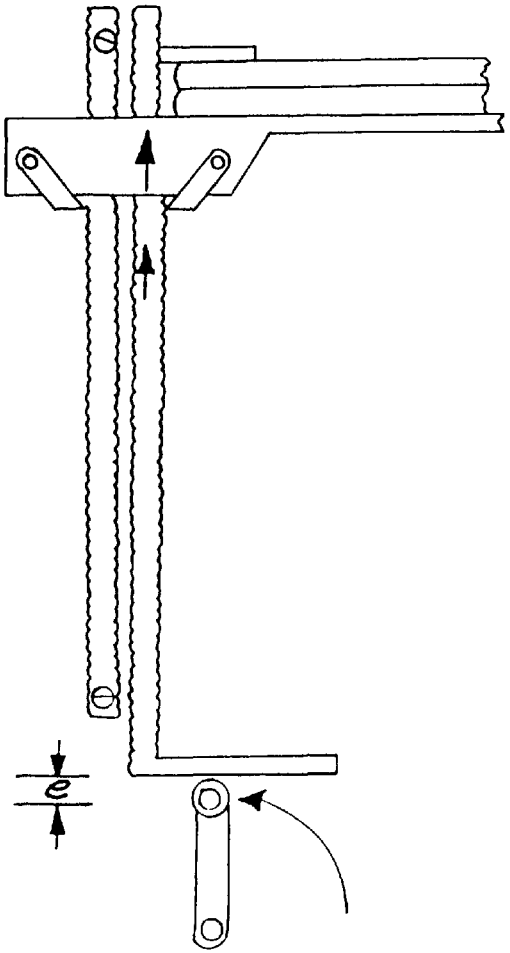
FIG. 29 is a view similar to that of FIG. 28 with the control system located at an operational height, in a lifted condition, with the operating handle in its pull-out position.
Figure 28:
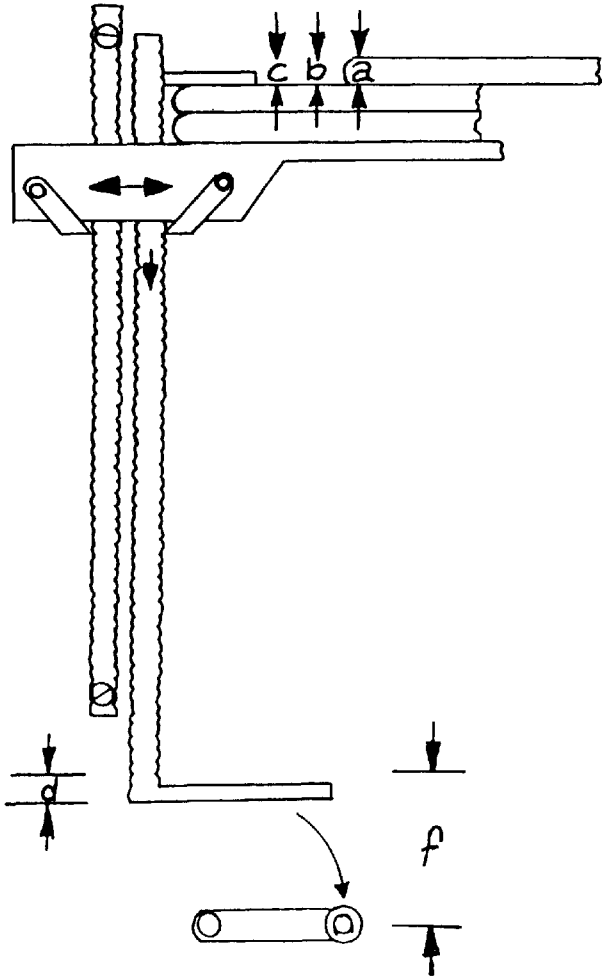
FIG. 28 is a view similar to that of FIG. 27 with the control system in its lower position and with the operating handle in its non-operative position.
Figure 27:
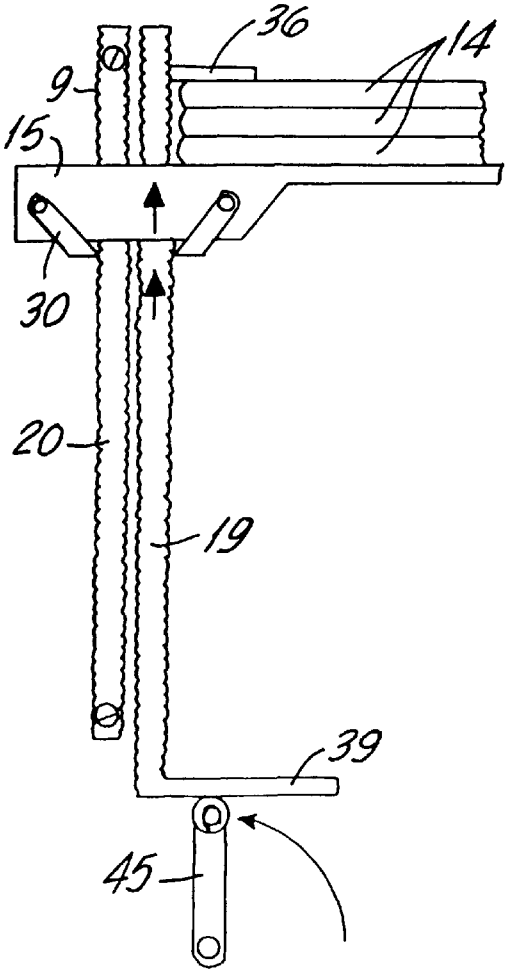
FIG. 27 is a schematic view of a lift and height control mechanism of a newspaper vending machine according to the present invention in a lifted position, with operating handle being pulled out.

For a trouble-free operation of the vending machine, maintaining of a constant, as possible, height is necessary. The height loss, resulting from delivery of the topmost newspaper, must be compensated during the next operating sequence. This requires a height adjustment. Despite the uniform strokes of the push lever, the height adjustment should insure a lifting of the transporting plate 15 a distance that would exactly correspond to the occurred height loss. The height adjustment is effected with a height regulator 36 shown in FIG. 11. The height regulator 36 is operationally connected, by a bolt 37, with a member 39 which is connected with the lower end of the detent rod 19. As shown in FIG. 11, the offset upper portion of the height regulator contacts the topmost newspaper so that, upon delivery of the topmost newspaper, the offset upper portion of the height regulator 36 falls onto the next newspaper and is lowered by an amount corresponding to the height loss equal to the thickness of the newspaper. Due to the operational connection of the displaceable detent rod 19 with the lower, likewise offset portion of the height regulator 36, the detent rod 19 will also be lowered by the same amount in the operational region of the push lever. As a result, the lift of the transporting plate 15 during the next operational sequence would be limited by the same amount. Thereby, a constant operational height is insured. This height adjustment is effected automatically and does not depend on the thickness of a newspaper (Sunday issue/work day issue). The foregoing process is shown in FIGS. 27–29 and does not require further explanations. For the sake of clarity, both the lift mechanism and the control regulator 36 are shown together in FIGS. 27–29 in a simplified form. The release spring 38, which forms part of the control regulator 36 and is shown in FIGS. 11–12, serves for reducing the pressure load of the height regulator 36 on the topmost newspaper to insure an effortless delivery of the topmost newspaper.

The topmost newspaper (please see FIGS. 1, 2, 9 and 10) on its way from the newspaper stack 14 to the delivery opening 4 is first fed to the display window 3, which serves as an intermediate station and in which the title sheet with an issue date is visible. The displayed newspaper is delivered to the delivery opening 4, from which it can be withdrawn, during the next operational sequence by opening the lower gate 55. Even if some elements of the vending machine malfunction, the display newspaper can be sold upon insertion of appropriate coins. An operational failure, all of the newspapers are sold out or a technical malfunction, will be quickly noticed by absence of a newspaper in the display window and/or by sign "sold out" on the rear wall of the display window 3. The display window 3, as shown in FIG. 3, includes left and right walls 65 and 66, respectively, a rear wall 67, and an unbreakable glass pane 68, with the right wall 66 carrying a control strip 48.

Figure 25:
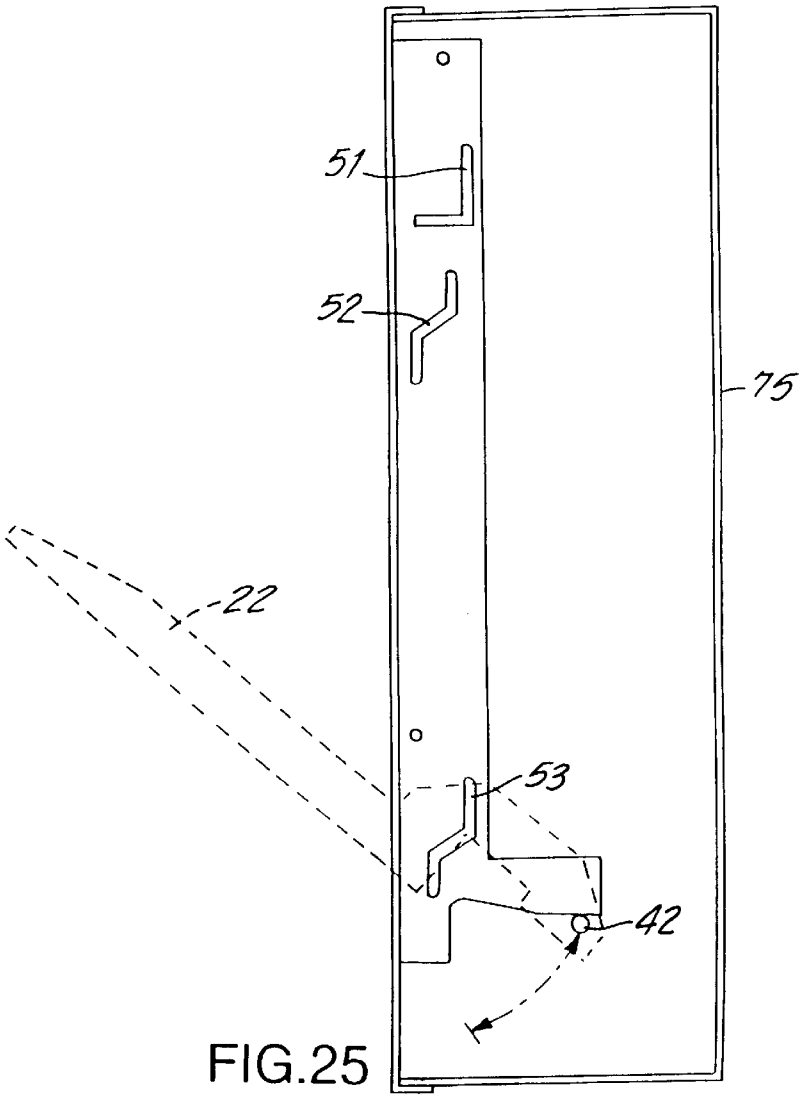
FIG. 25 is a view similar to that of FIG. 24 with the operating handle in its pull-out position.
Figure 24:
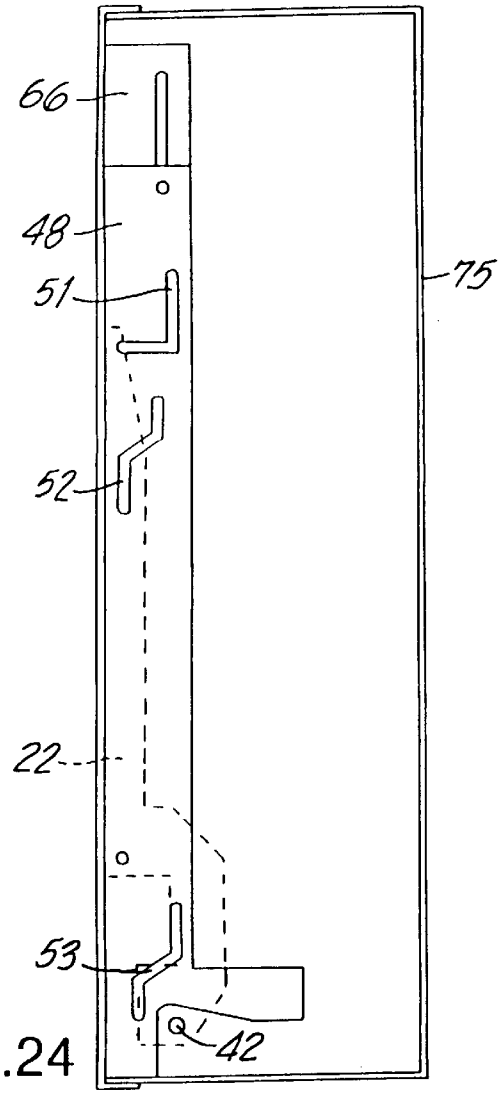
FIG. 24 is a schematic side view of the newspaper vending machine with the right side wall being removed and showing an assembly including a control bar in a non-operative position and the operating handle.
Figure 26:
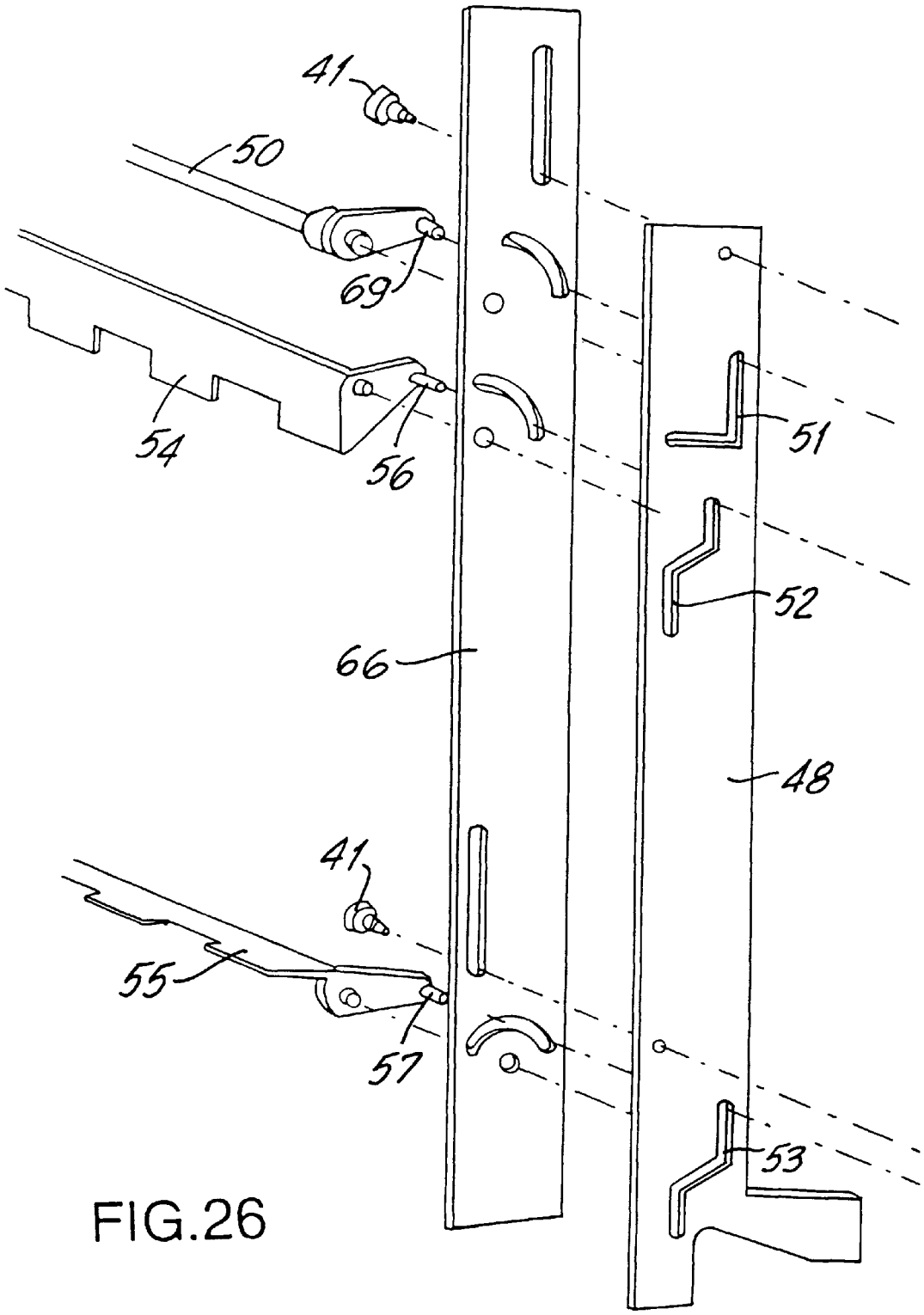
FIG. 26 is a schematic exploded view of an assembly of newspaper vending machine according to the present invention and including the control bar and upper and lower closing gates.

As shown in FIGS. 9, 10 and 26, the display window 3 has an upper gate 54 and a lower gate 55, the upper and lower gate 54, 55 are alternatively opened and closed by the operating handle 22 and the control bar 48. The gates 54, 55 prevent an unauthorized access to the housing 1 of the vending machine. The alternative opening and closing of the gates 54 and 55 is effected in a manner of sluice, i.e., in no time both gates 54 and 55 are simultaneously open. This prevents the next paper from being fed to the display window 3 before the bought newspaper is withdrawn and the lower gate 55 is closed. The control of the alternating opening and closing of the gates 54, 55 is effected with the control bar 55 which is actuated upon the actuation of the operating handle 22 by a carrier bolt 42 (see FIGS. 24, 25). As shown in FIGS. 3, 24 and 26, the control bar 48 is secured to the side wall 66 of the display window with bolts 41. The control bar 48 is provided with guide slots 52, 53 for the upper and lower gates 54 and 55 respectively, with the control bar 48 being operatively connected with the upper and lower gates 54 and 55 by guide bolts 56, 57, respectively.

The control strip 48 cooperates with two delivery push arms 58 which extend parallel to each other and serve for displacing the topmost newspaper toward the display window 3 or the delivery opening 4. As shown in FIG. 26, a common shaft 50 of the two push arms 58 is connected with the control bar 48 by a guide bolt 69 which extends into a slot 51 provided in the control bar 48. The push arm 58 is arranged, as particularly shown in FIGS. 16–19, in a housing and swings-out therefrom. The displacement of the push arm 58 is effected by means of a slide strip 59, which cooperates with a guide member 60 and which is connected by a connection pin 61 with the push arm 58. The displacement of the push arm 58 is effected via the shaft 50. To insure freedom of movement of the push arm 58, a guide slot 70 is provided. Each push arm 58 has a needle carrier 62 for carrying a delivery needle 72.

In addition, the push arm 58 is provided with a support 71 (see FIG. 15). The delivery needles 72, in the operating position, are lowered to engage the topmost newspaper, move it on the inclined stack in a direction toward the rear wall 75 of the housing 1 from out of the hold of the bent-out portion of the height regulator 36, and release that paper when swinging back into the push mechanism housing 49, at the end of the return travel.

Figure 31:
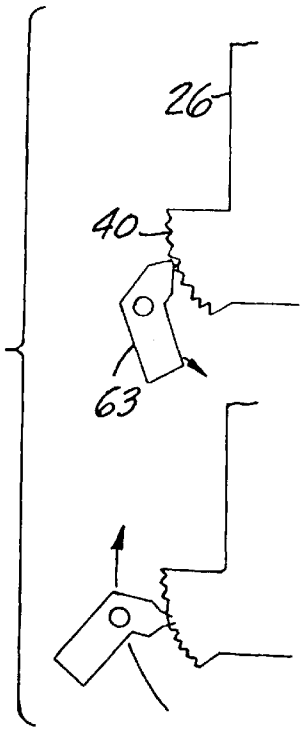
FIG. 31 is a side view of the stop and the reversing pawl.

As shown in FIGS. 9, 10 and 20–26, the operating handle 22, upon being released by insertion of appropriate coins, is swung out against the bias of a return spring 23 shown in FIG. 30. A reverse pawl 63 prevents an early return of the handle 22 and cooperates, to this end, with a toothing 40, provided on a stop 26, as shown in FIGS. 30–31. The operating handle 22 is associated with a lift roller 24 shown in FIG. 3. The work arm 25 of the operating handle 22 pushes the push lever power arm 44 and the control bar 48 upward and provides for lifting of the newspaper stack 14 upward to a desired operating height g, for delivering of the topmost newspaper from beneath the height regulator, for closing of the upper gate 54, release of the coin mechanism 64, and for delivery of the coins into a money cassette. Before actuation of the operating handle 22, the inserted coins can be withdrawn by actuating the coin return knob 6.

When the operating handles 22 swings into its initial position, the push lever (43, 44, 45) returns to its initial position. The control bar 48 is lowered by its own weight with an assist, if necessary, of a return spring, to its initial position, as soon as the sold newspaper is withdrawn. During this phase, the push arm 58 moves away from the newspaper stack 14 back into the housing 49. The transporting plate 15 is retained at a desired level by the pawl 30, and the bent out portion of the height regulator 36 engages the next newspaper. The locking fishplate 9 of the operating handle 22 is again locked in the coin mechanism. In this way, the vending machine becomes ready for selling the other newspapers unless, of course, all newspapers are sold out.

Another, footed embodiment of a newspaper vending machine according to the present invention is shown in FIGS. 32–63. In FIGS. 32–63, some of the elements similar to those of FIGS. 1–31 will be designated with the same reference numerals with a prime index "'".

Figure 34:
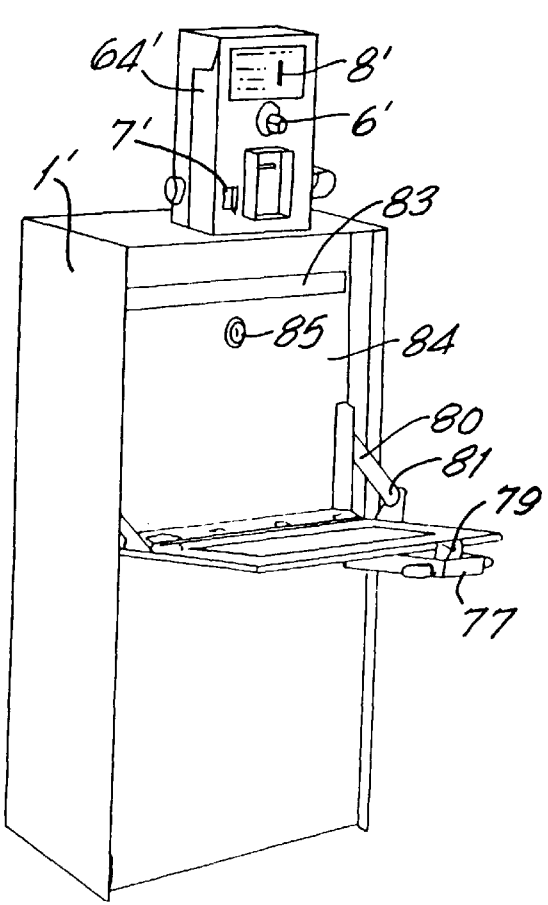
FIG. 34 is a perspective view similar to those of FIGS. 32–33, with the hinged door being completely open.
Figure 33:
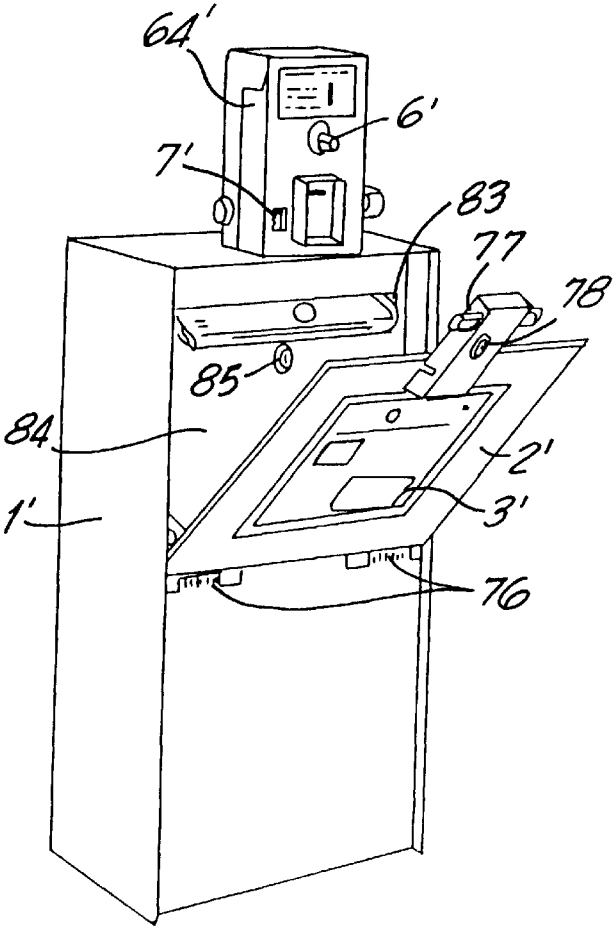
FIG. 33 is a perspective view similar to that of FIG. 32 but with the hinged door being partially open.
Figure 32:
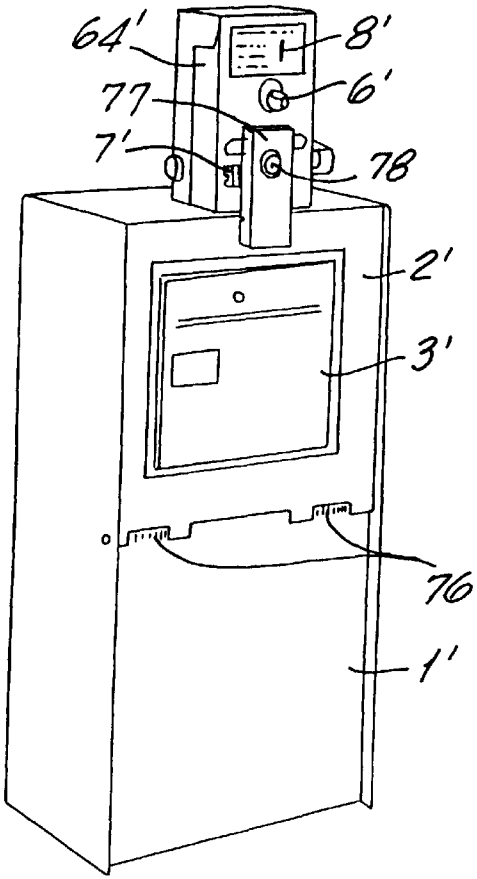
FIG. 32 is a perspective view of a second embodiment of a newspaper vending machine according to the present invention, with a newspaper displayed in a display window of the machine.
Figure 42:
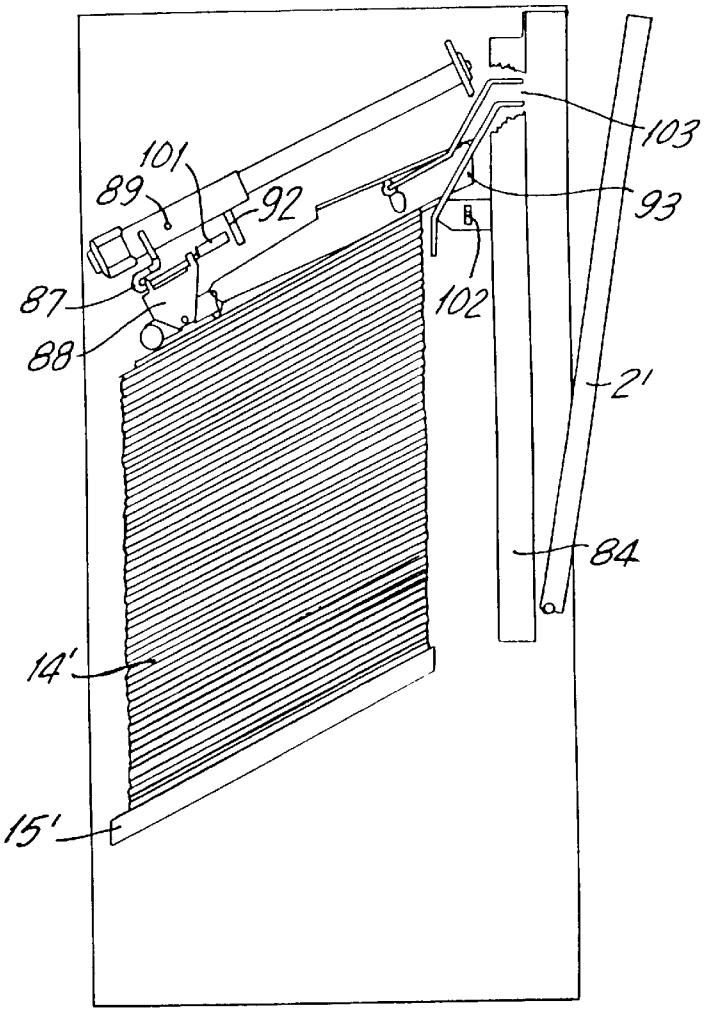
FIG. 42 is a view similar to that of FIG. 41 at the beginning of the transporting process.
Figure 41:
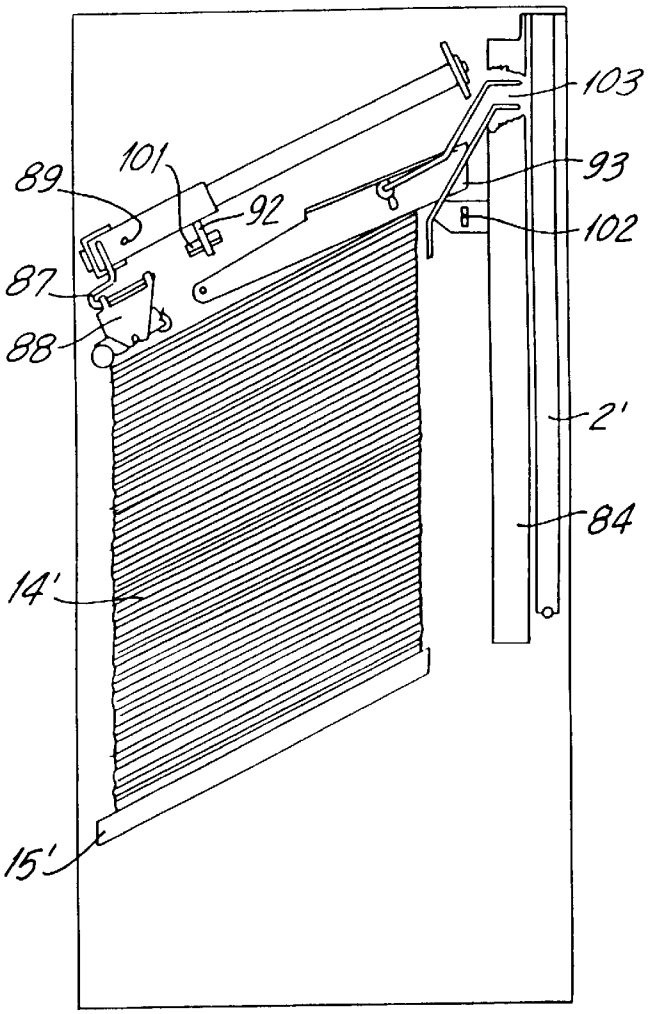
FIG. 41 is a side view of the transporting system with the newspaper stack in the non-operative position.

The vending machine, which is shown in FIGS. 32–34 with three possible positions of the front door, includes a housing 1', a hinged front door 21' which is provided in the upper portion of the housing 1' and is spring-biased into its closing position by a spring 76, and an automatic coin mechanism 64' provided with a coin insertion slot 8', a coin return knob 6', and a coin return opening 7'. The front hinged door 2' has a display window 3' and a door handle 77 in which an opening lock 78 with a snap locking element 79 is located. The front door 2' is connected by a connection member 80, to which the door is connected by a connection bolt 81, with an operating handle 82. The newspaper delivery slot 83 is formed in the housing inner door 84 equipped with a lock 85, the fishplate 102 of which is shown in FIGS. 41–42.

In the embodiment shown in FIGS. 32–63, a newspaper drive mechanism is actuated by opening of the front door 2'1, which is released upon insertion of appropriate coins. The opening of the front door 2' provides for movement of the operational handle 82, which is connected with a slidable sleeve 86 to a connection rod 87 of the newspaper delivery push element 88. The lever 82 is connected to the sliding sleeve 86 with a connection bolt 89. For displacement of the sliding sleeve 86 between its position corresponding to the positions of the front door 2', a guide bar 90 is provided. The sleeve 86 has a support bolt 92, the function of which will be explained later. The elements of the door displacement mechanism are mounted on the right side door 91 of the housing 1' by means of a mounting plate 91'. Also mounted on the mounting plate 91' are a large ramp 93 and a ratchet 94, the functions of which will also be explained later.

The drive for lifting of the newspaper stack to a constant predetermined level is likewise effected upon insertion of coins in the coin mechanism and by resulting opening of the front door 2'. The lifting of the newspaper stack is effected by lifting of the transporting plate 15', on which the stack 14' is supported, by a displaceable detent rod 19'.

Figure 37:
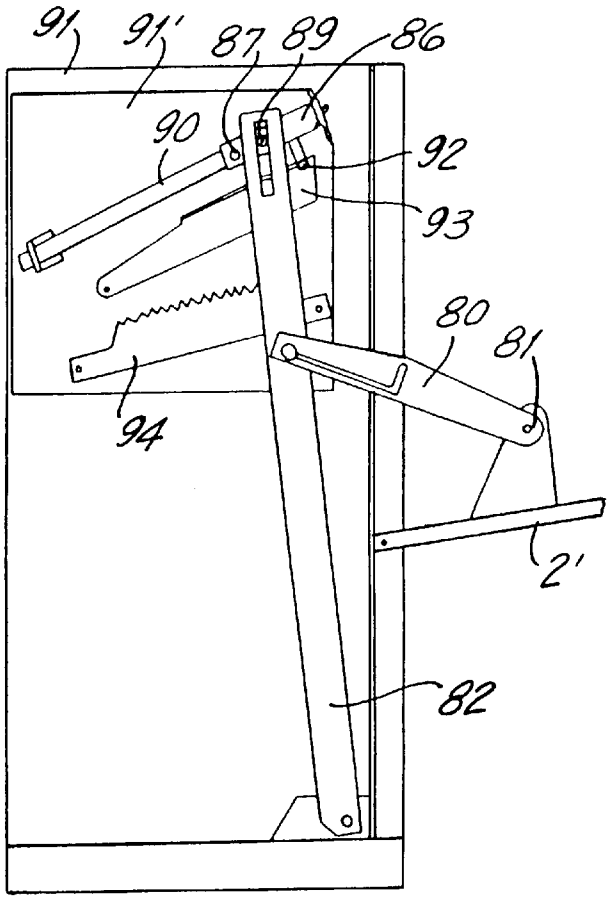
FIG. 37 is a view similar to that of FIG. 36, with the hinged door being completely open.
Figure 36:
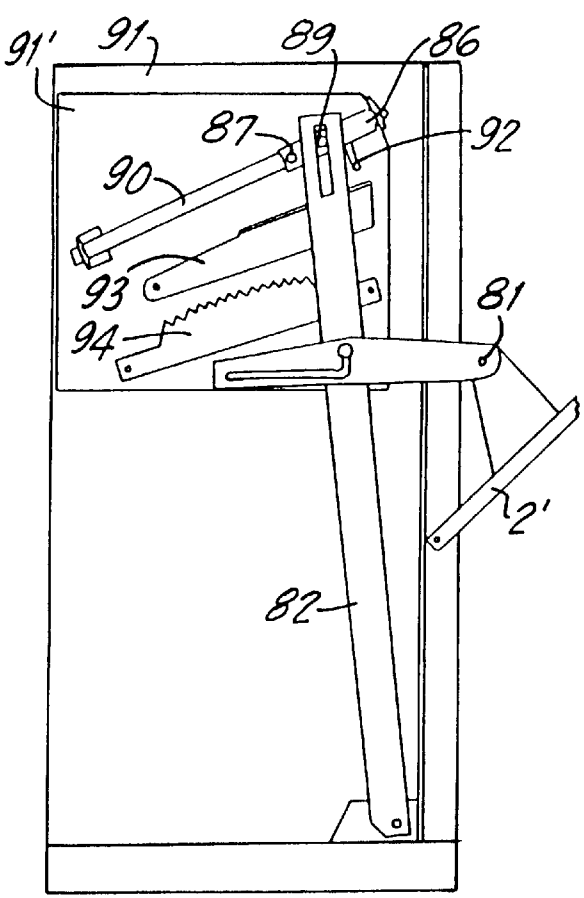
FIG. 36 is a view similar to that of FIG. 35, with the hinge door being partially open.
Figure 35:
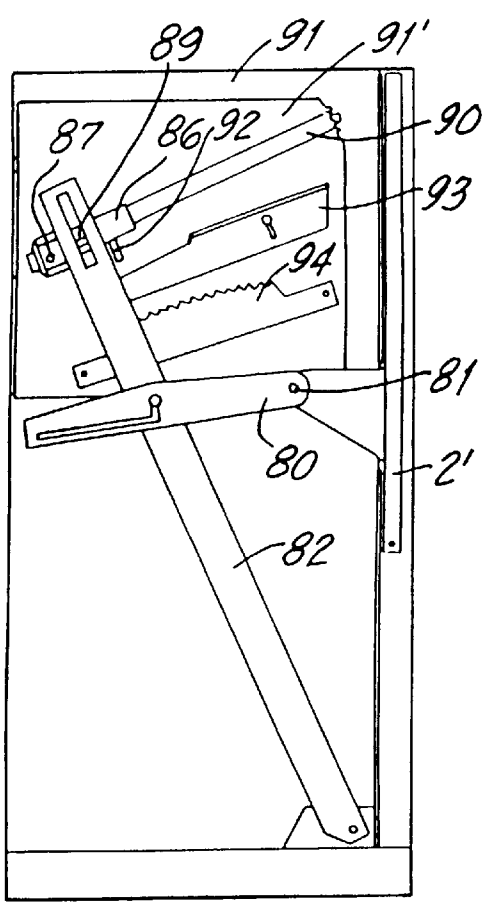
FIG. 35 a view showing the inner side of the right side wall of the machine, with the drive and transporting elements in their non-operative positions.

FIG. 37 shows the door 2' completely open. The delivery push element 88 has been manually turned upward and is retained in this position by cooperation of the support bolt and the also manually lifted big ramp 93.

Upon opening of the hinge front door 2', the delivery push element 88, the rocker 96 of which engages the topmost newspaper, is pushed in the direction of the delivery slot 83. At that, delivery needle 97, which is supported on a needle carrier 97' pushes the topmost newspaper forward through the delivery pit so that a buyer can withdraw the newspaper from the vending machine. The positions of the elements of the push element 88 during its delivery and return movement is shown in FIGS. 61*a, b*, where 96' designates a stop for the needle carrier 97'.

Figure 63A:
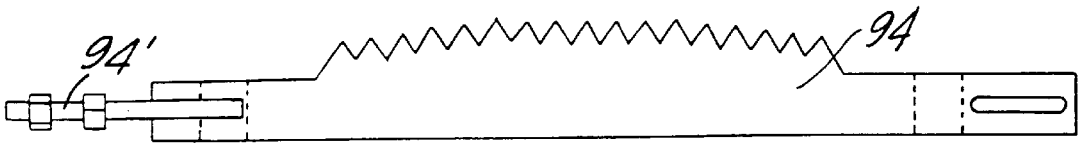
FIG. 63*a* is a front elevational view of a ratchet, controlling the operation of the delivery push element.
Figure 63B:
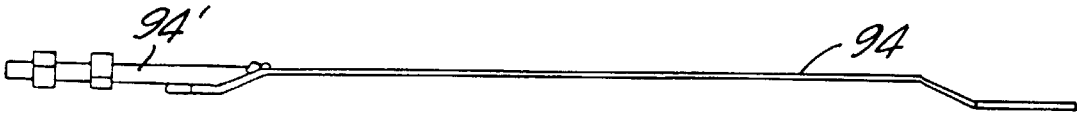
FIG. 63*b* is a plan view of the ratchet shown in FIG. 63*a*.

A reverse pawl 98, which cooperates with the ratchet 94, prevents the operational process from not being completely executed. At that, closing of the front door 2' becomes possible only after it has been opened up to engagement with a stop which defines a partially open position of the front door at which a newspaper can be withdrawn. This prevent withdrawal of the next and following newspapers besides the newspaper which was paid for by multiple movement of the front door 2' between the door closing and partially opening positions, which is called "pumping" by specialists in the art. The ratchet 94 can be so adjusted that the reverse point of the reverse pawl 98 is reached timewise after latching of the door 2'. Thereby, an early disengagement of the pawl 98 from the ratchet 94 before closing of the door is prevented. For adjusting the position of the ratchet 94 a threaded bolt 94', which is shown in FIGS. 63*a* and 63*b*, is provided.

"Pumping" at the completely open position of the door is prevented by a possibility of the operating lever 82 to be pulled, against a spring bias, somewhat further than the delivery push element 88. Disengagement of the reverse pawl 98 from the ratchet 94, reversing, and its subsequent engagement with the ratchet 94 is effected within the distance by which the lever 82 is pulled beyond the push element 88, with the push element and the delivery needle remaining in the non-operative position.

When newspapers, the size of which is smaller than the size of the transporting plate 15', from front to back, need to be sold, the rear limiting bars should be correspondingly adjusted so that the front edge of the stacked papers remain about flush with the front edge of the transporting plate 15'. With a reduced-size-newspaper stack that leaves an enlarged gap between stack and rear wall 111, the delivery push element 88 looses supporting surface and, thus, stability. This is counteracted by a small ramp 101, which, in cooperation with the support bolt 92 prevents the delivery push element from being lowered below the operating height.

Figure 38:
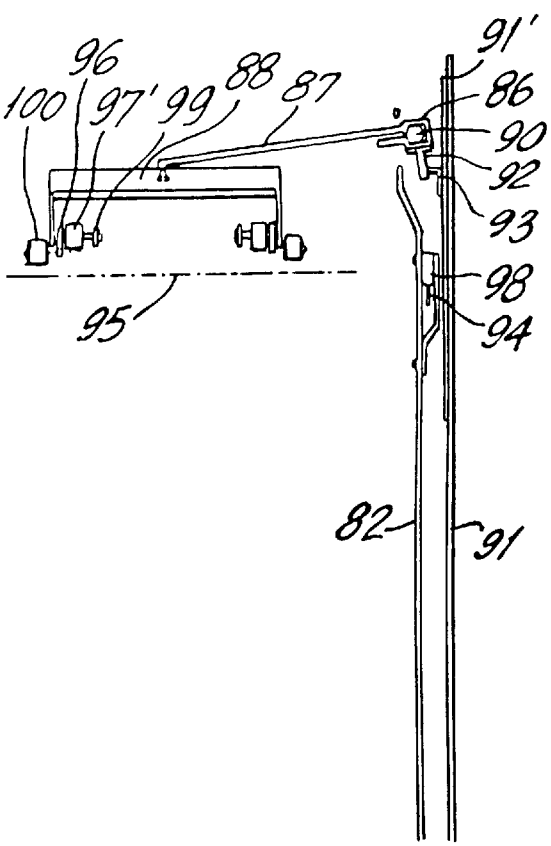
FIG. 38 is a schematic view of the newspaper transportation system of the newspaper vending machine shown in FIG. 32 in its non-operative position.

FIG. 38 shows the delivery push element 88 in its non-operative position, in which the support bolt 92 is retained against the small ramp 101 and supports the push element in a slightly elevated position.

Figure 39:
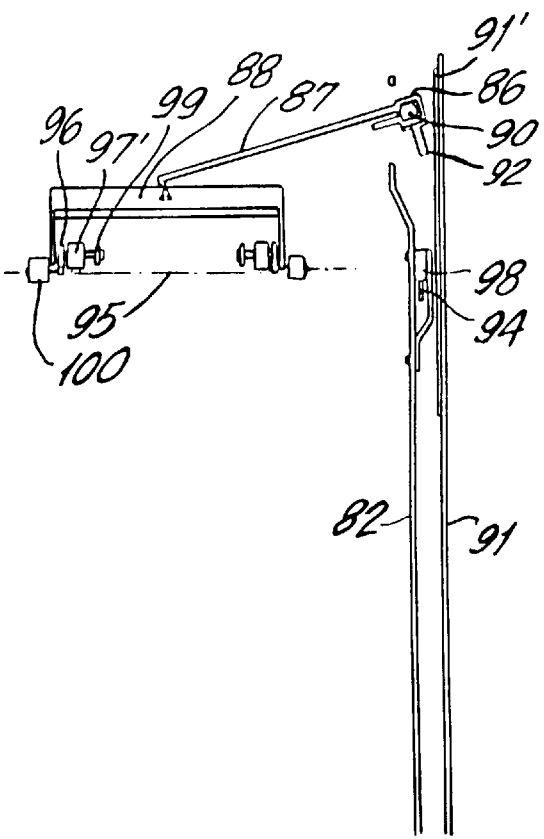
FIG. 39 is a schematic view of similar to that of FIG. 38, with the transporting system being in a process of transporting newspapers and with the push arm engaging the newspaper stack.

FIG. 39 shows the delivery push element 88 in its operating position when it engages the newspaper stack.

Figure 40:
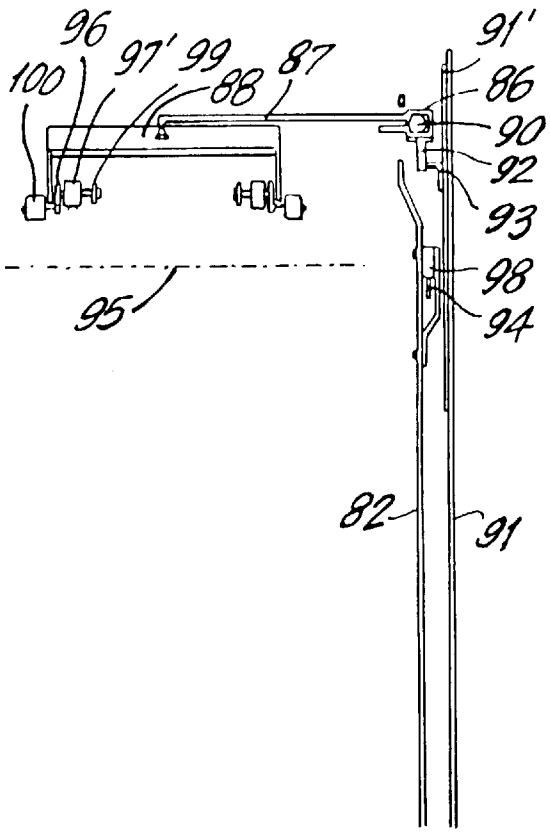
FIG. 40 is a view similar to those of FIGS. 38–39 in a "Fill" position.

FIG. 40 shows the push element 88 in its "fill" position when the support bolt 92 supports the push element at an elevated position due to the engagement with the large ramp 93.

FIG. 41 shows a side view of the delivery system with the newspaper stack in a rest position. The support bolt 92, which is supported against a small ramp 101, supports the push element 88 in a position slightly above the newspaper stack 14'.

FIG. 42 shows a side view of the delivery system at the beginning of the delivery process. The delivery push element 88 lies on the stack and pushes the topmost newspaper with its needle forward through the delivery pit 103.

Figure 43:
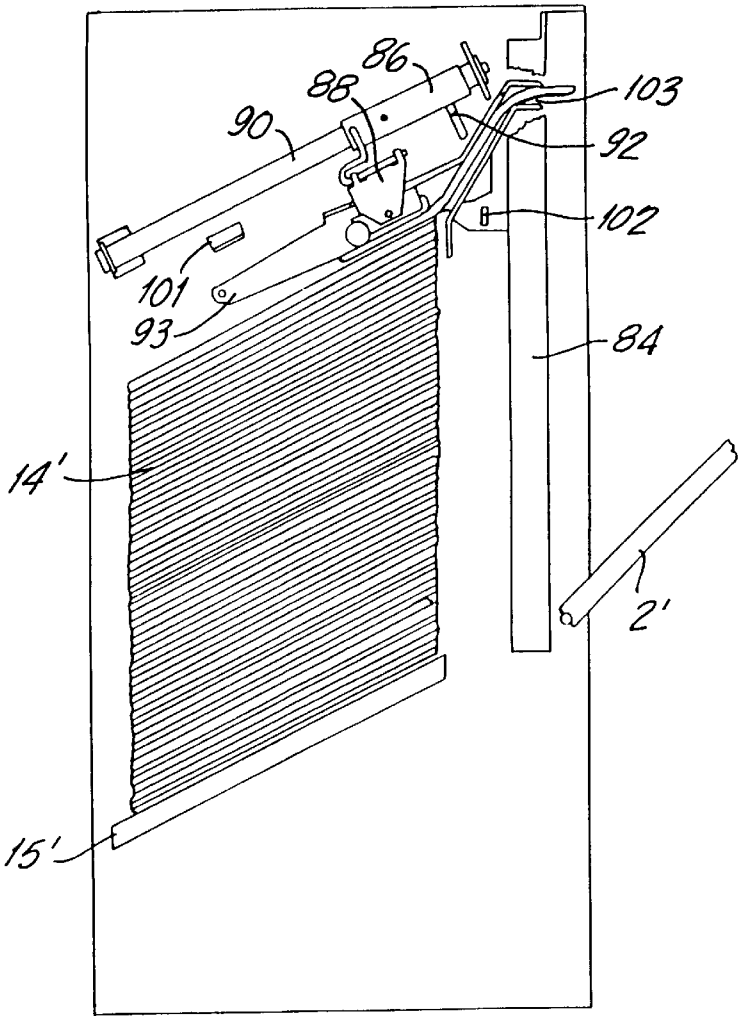
FIG. 43 is a view similar to that of FIGS. 41–42 at the end of the transporting process with the hinged door being partially open.

FIG. 43 shows a side view of the delivery system at the end of the delivery process, with the front door 2' being partially open.

Figure 44:
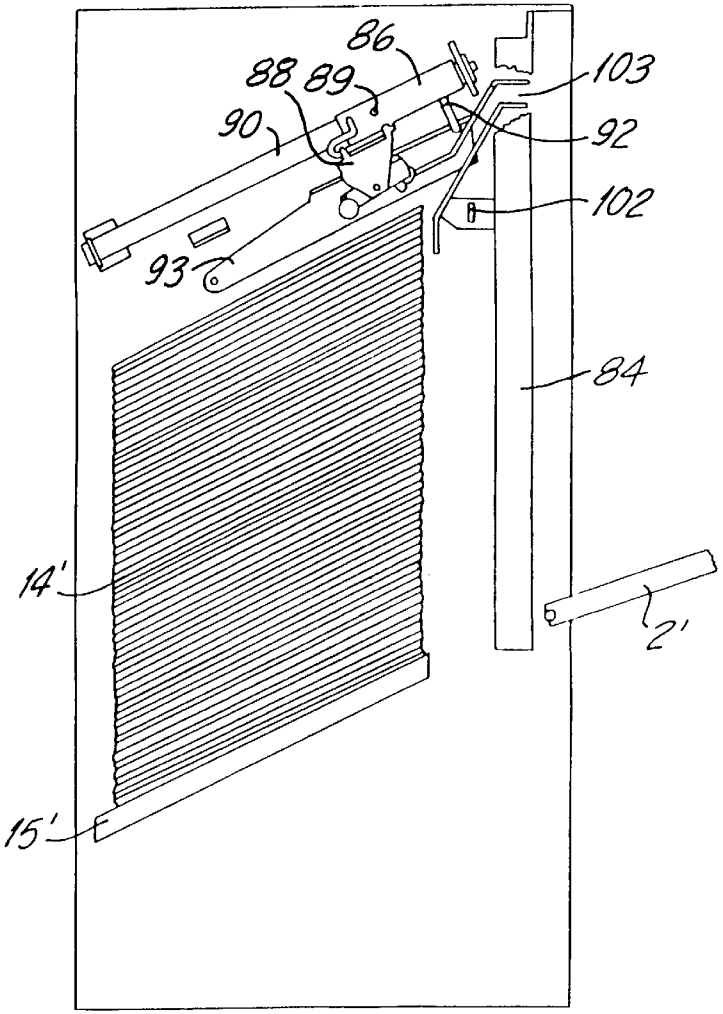
FIG. 44 is a view similar to that of FIGS. 41–43 in the "Fill" position.

FIG. 44 shows the delivery push element 88 in the "fill" position. The push element 88 is supported on the large ramp 93, when the front door 2' is completely open as shown in FIG. 34.

Figure 49:
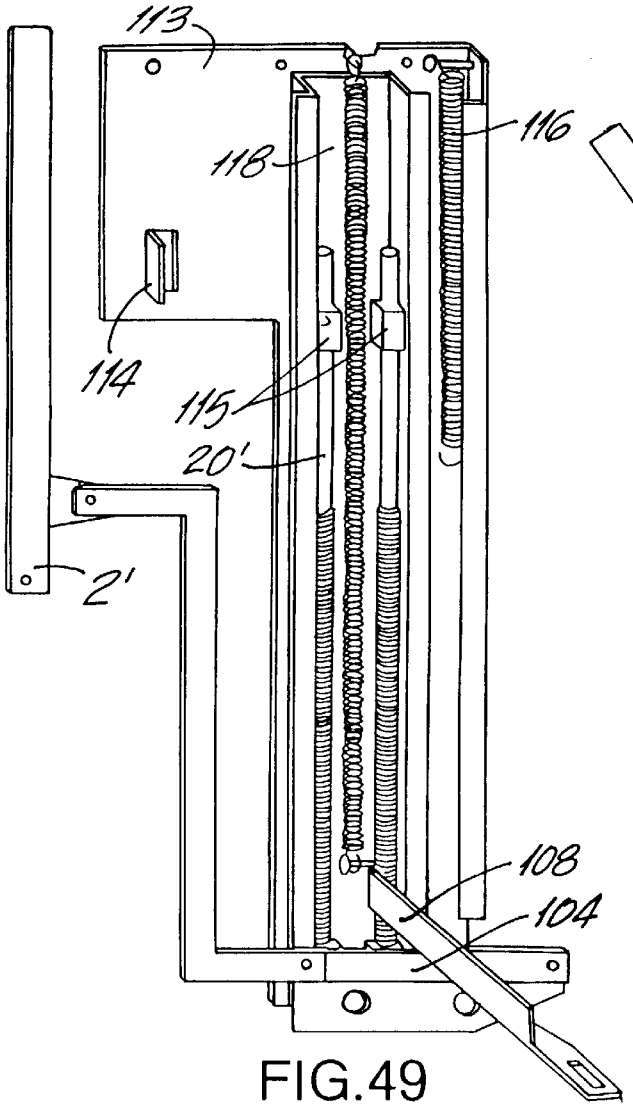
FIG. 49 is a perspective view of the lift mechanism in its non-operative position.
Figure 52:
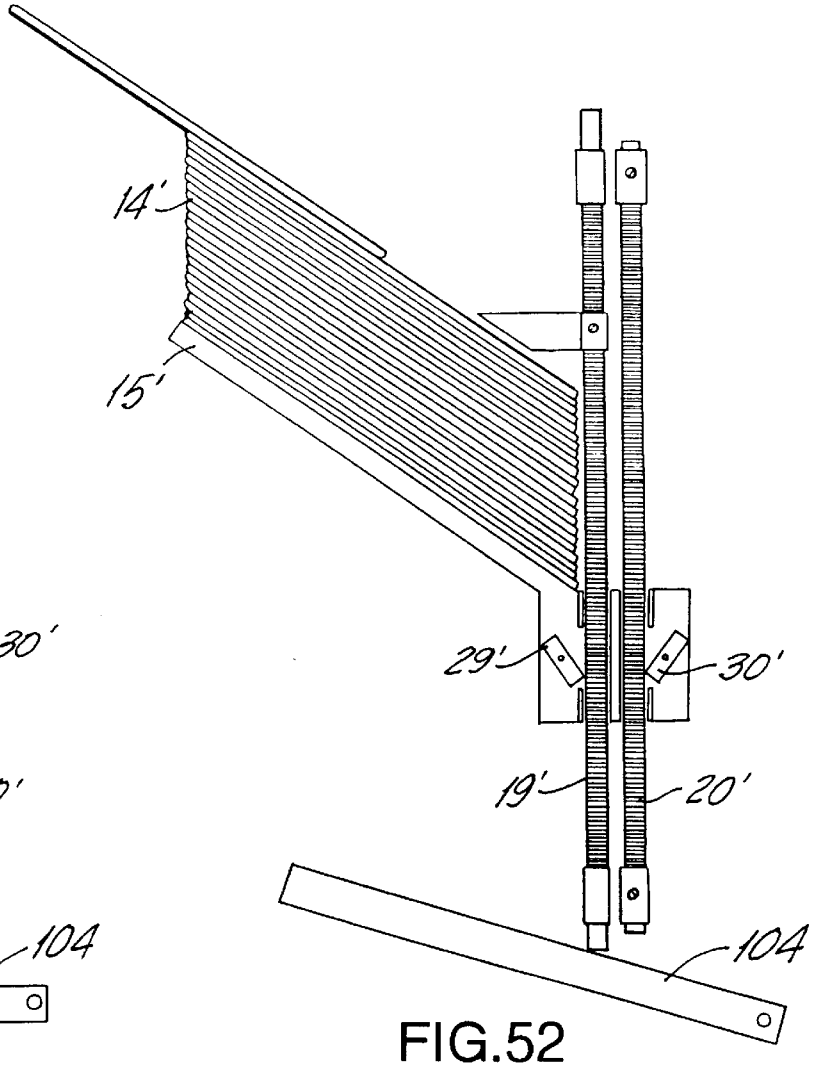
FIG. 52 is a view similar to that of FIGS. 51 but with a lifted driving lever.
Figure 51:
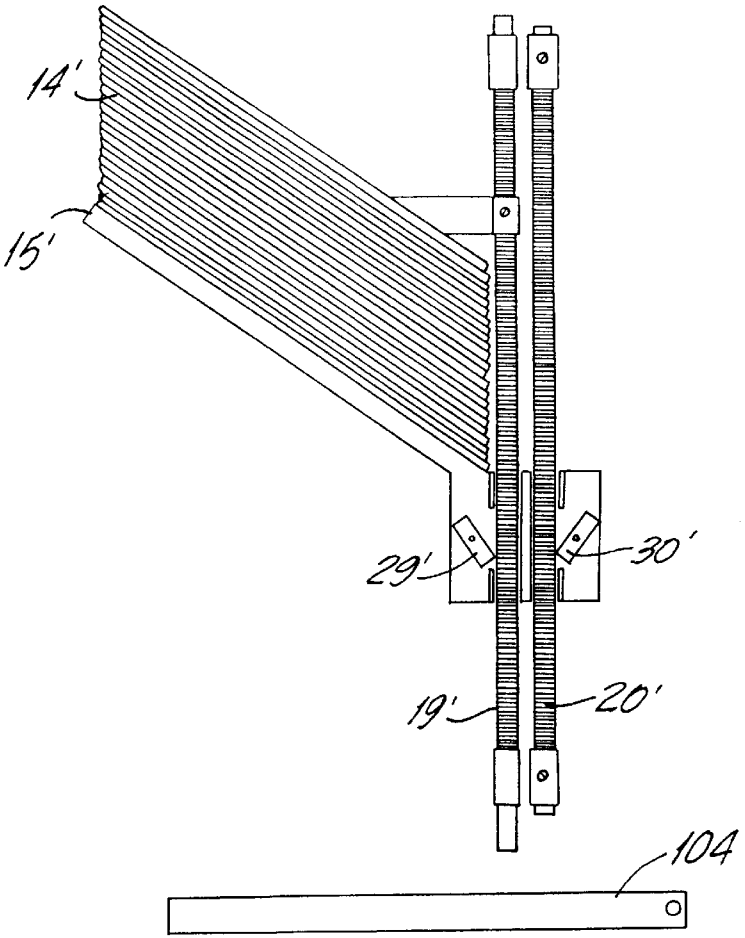
FIG. 51 is a schematic side view of the lift mechanism in its non-operative position.

Lifting of the transporting plate 15' with the newspaper stack will be described now with reference to FIGS. 45–54. At each opening of the hinged front door 2', a lever 104 is lifted by a connection member 105 connected with the front door 2' to the predetermined constant height. When the front door 2' becomes closed, the lever 104 moves to its lower, rest position (FIGS. 49 and 51).

The vertically displaceable detent rod 19' is lifted by the same amount as the lever 104 which lifts the detent rod 19'. Upon being lifted, the detent rod 19' remains in the operational region of the lever 104. The displacement of the detent rod 19' in the operational region of the lever 104 is controlled by the height regulator 36', which so controls the displacement of the detent rod 19' that the newspaper stack is always lifted to the same, predetermined height. This control is effected by cooperation of the upper support element 106 of the height regulator 36' with the height regulator lower support element 107 which engages the detent rod 19' its connection part 108. With each delivery of a newspaper, the height regulator 36' lowers by the thickness of the newspaper onto the new newspaper which becomes a topmost newspaper. Simultaneously, the lower support 107, the connection part 108 and, as a result, the detent rod 19', are lowered by the same amount and are located in the operational region of the lever 104. As a result, during the next operational sequence, the detent rod 19' will be lifted by the same amount to a predetermined operational height. The lift of the detent rod 19' causes the lift of the transporting plate 15' by the same amount. For lifting the transporting plate 15', a pawl 29', which cooperates with detent rod 19', is provided. The pawl 30', which cooperates with the stationary detent rod 20', insures retaining of the transporting plate 15' at predetermined height level.

Figure 45:
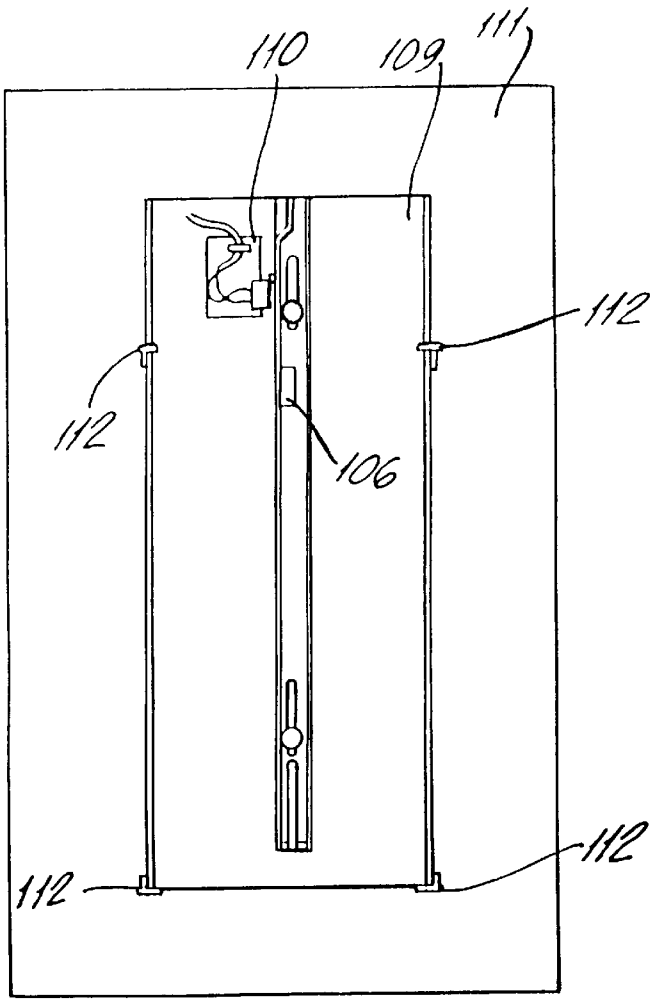
FIG. 45 is a view showing the inner side of rear wall of the machine shown in FIG. 32.
Figure 48:
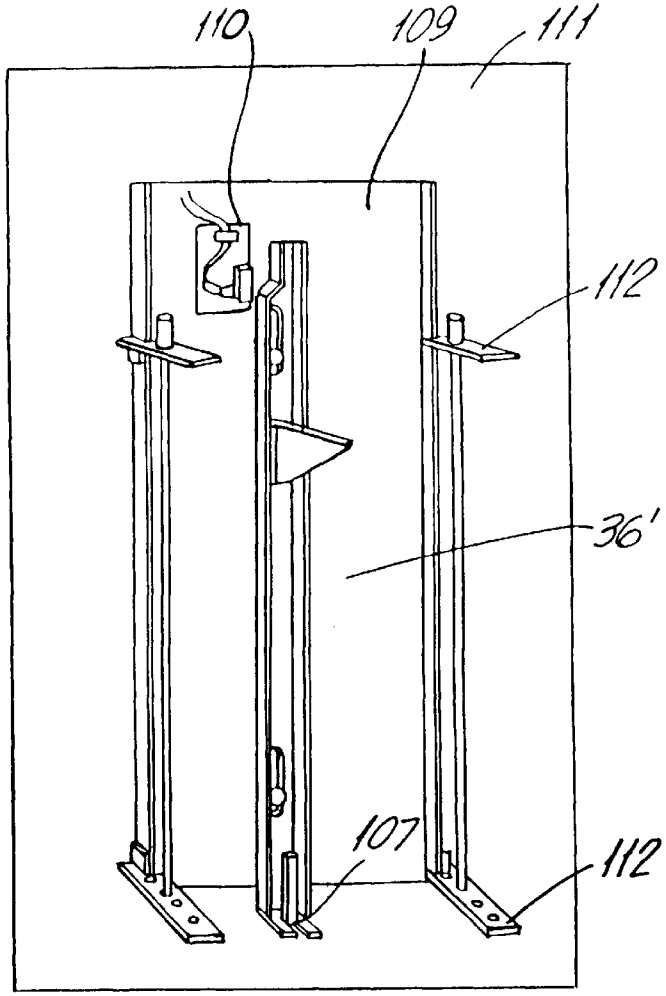
FIG. 48 is a view similar to that of FIG. 47 in a "SOLD OUT" position.
Figure 47:
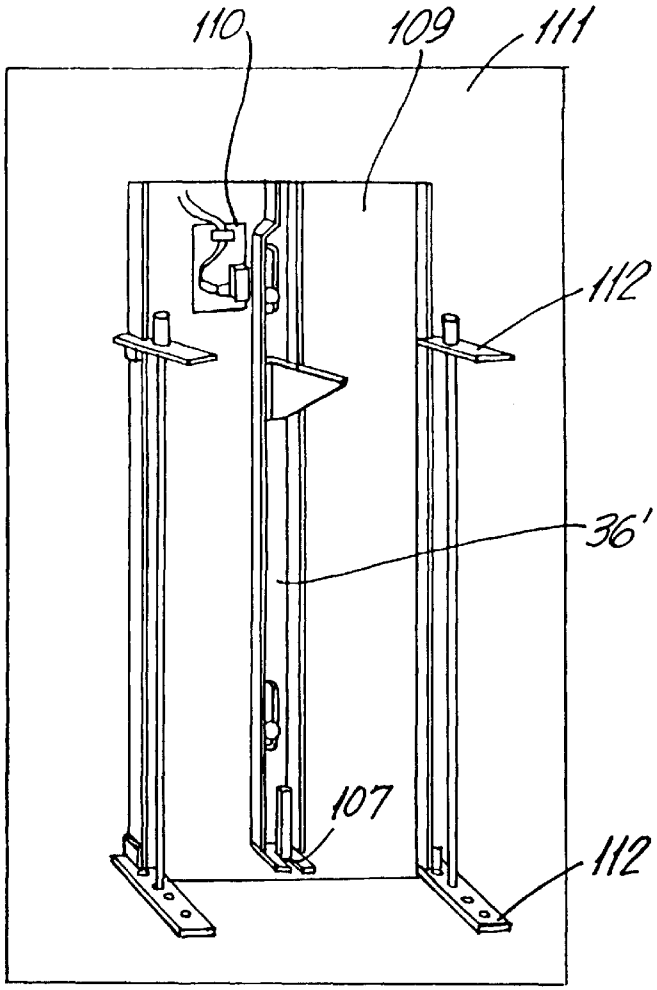
FIG. 47 is a perspective view of the inner side of the machine rear wall.
Figure 50:
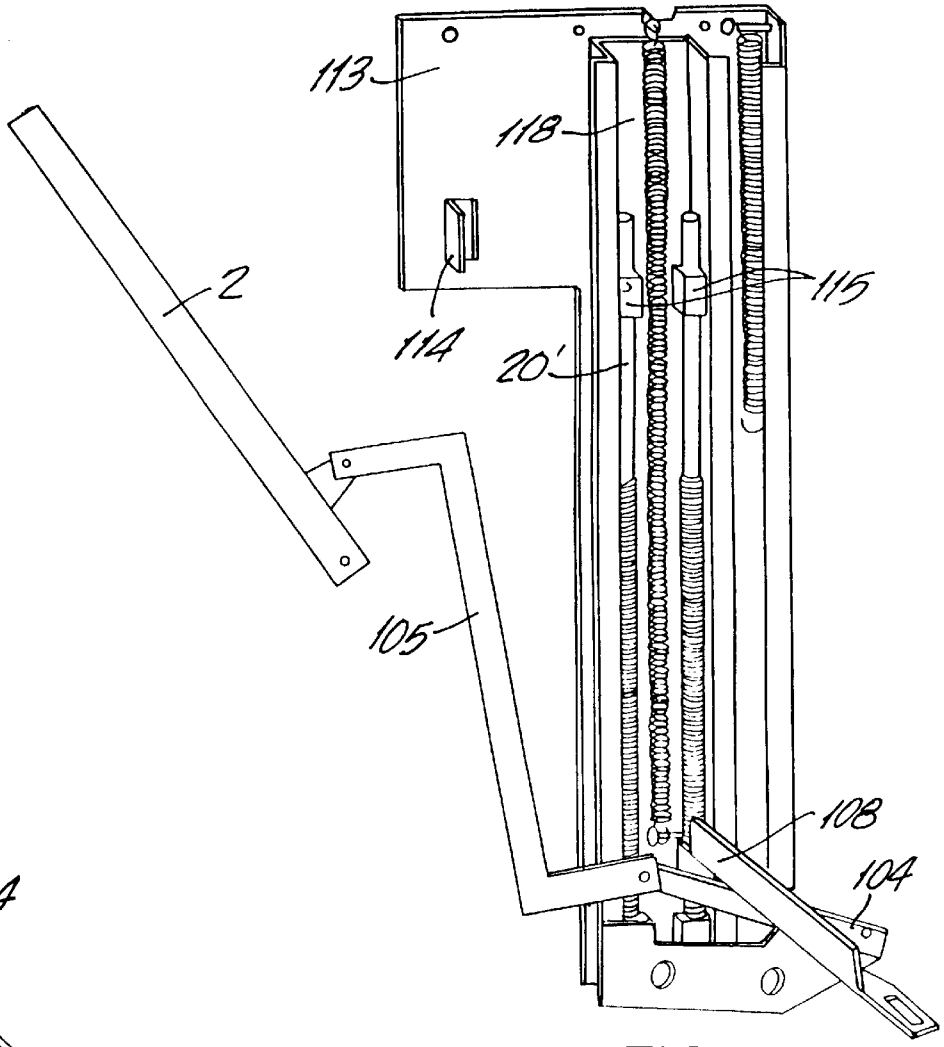
FIG. 50 is a view similar to that of FIG. 49 but showing the lift mechanism during a lifting process.

FIG. 45 shows a view of the inner side of the rear wall of the machine housing with a mounting plate 109, the height regulator 36', and a "sell out" switch 110 in their operational positions. The mounting plate 109 is supported against a rear wall 111 of the machine housing 1'. The rear stack limiting elements are designated with a reference numeral 112.

Figure 46:
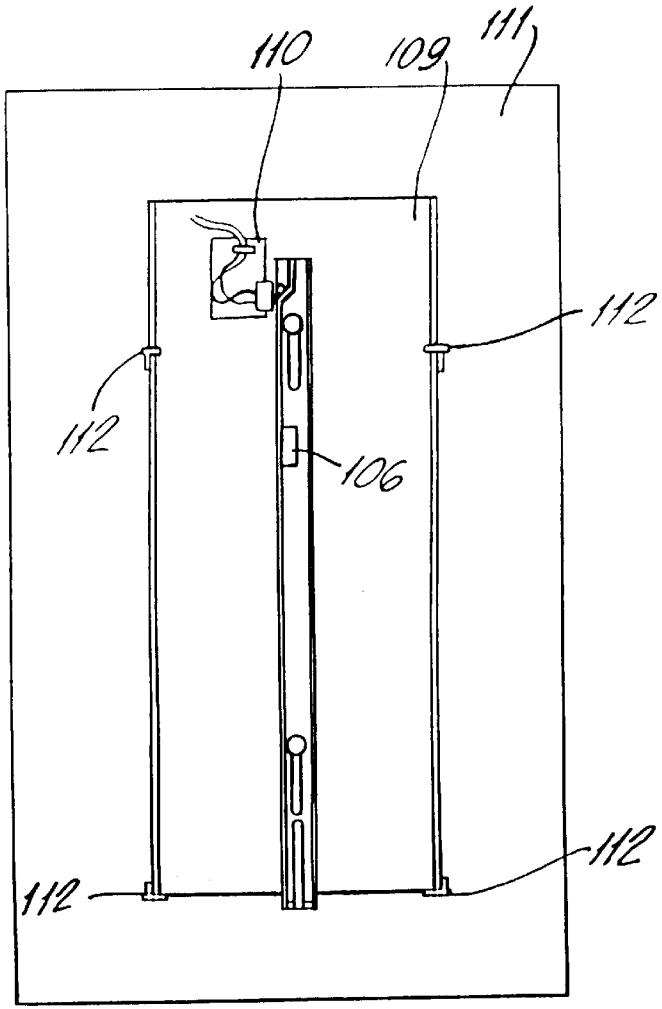
FIG. 46 is a view similar to that of FIG. 45 in the "SOLD OUT" position.

FIG. 46 shows the same view as FIG. 45 but in a "sold-out" position. After the delivery of the last newspaper, the height regulator sinks under its own weight, causing the "sell out" switch 110 to interrupt the flow of current to the coin mechanism so that the coin mechanism does not accept coins any more.

The lift mechanism is mounted on a support plate 113 (FIGS. 49, 50) on which stops 114 for the inner door 84 are also provided. Both detent rods 19', 20' are supported in guide sleeves 115. The lift mechanism also includes release springs 116, 117 for the transporting plate 15' and the displaceable detent rod 19'. A guide rail 118 is likewise provided on the support plate 113.

Figure 54:
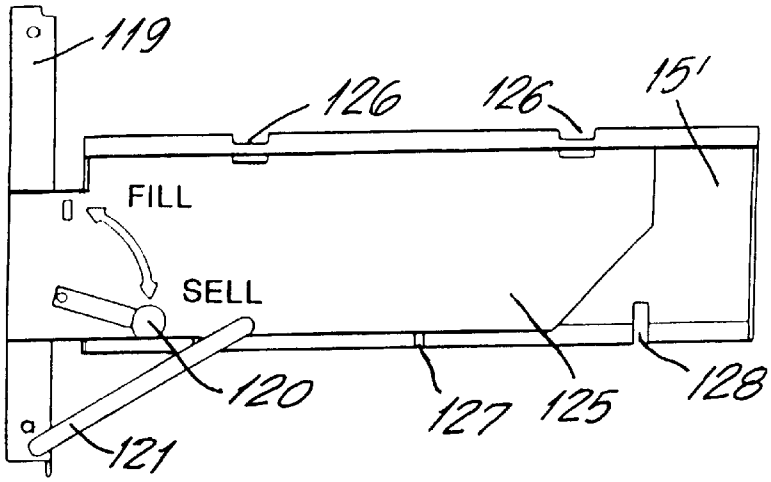
FIG. 54 is an elevational view showing the transporting plate with a carrier and the sliding carriage.
Figure 53:
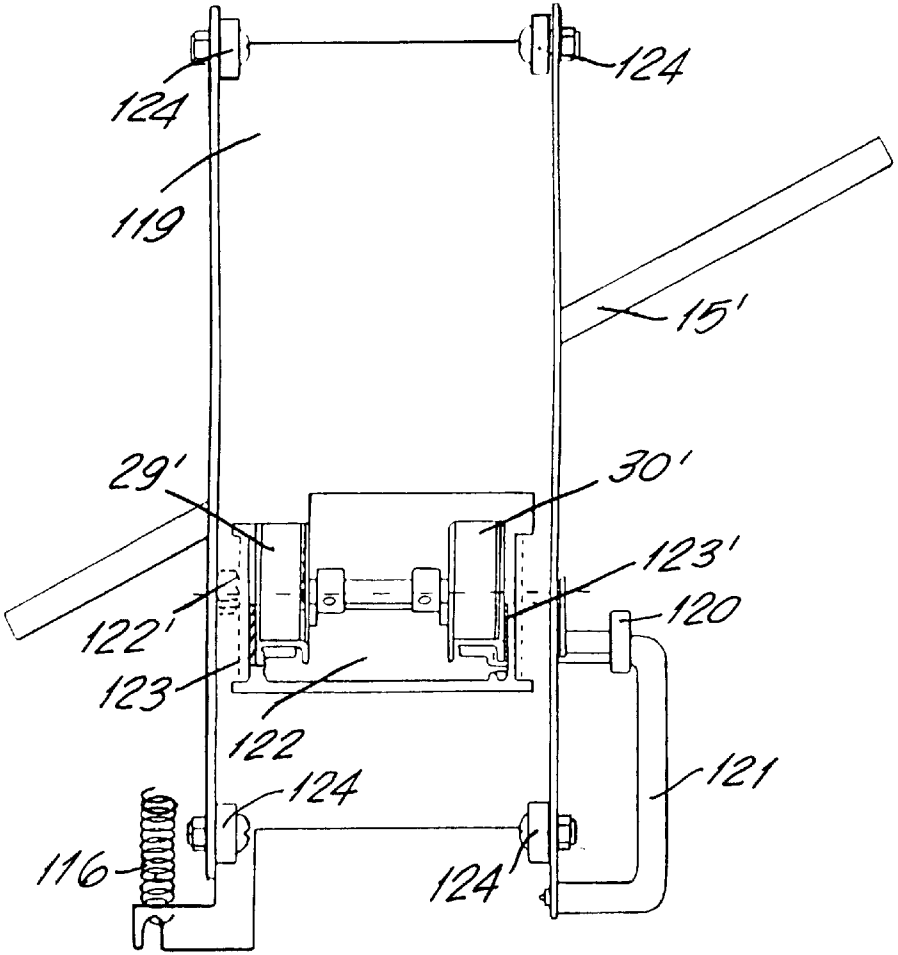
FIG. 53 is an elevational view showing the sliding carriage of the lift mechanism.

FIGS. 53 and 54 show a sliding carriage 119 for vertically displacing the transporting plate 15'. As shown in FIGS. 53 and 54, a change-over lever 120 is supported on a handle 121 fixedly secured to the carriage 119. The change-over lever 120 operates a change-over rocker 122 for changing the positions of the pawls 29' and 30' which cooperate with the displaceable and stationary detent rod 19' and 20', respectively, and are connected to the rocker 122 by springs 123 and 123', respectively. The carriage 119 is provided with running wheels 124 for displacement along a guide rail 118. The transporting plate 15' is supported on the sliding carriage 119 by a support 125.

The transporting plate 15' is provided with slots 126, 127 and 128 for the delivery needle, limiting bars, the height regulator slots 36', and chute brake 126'.

The hinged front door 2' can be open by inserting an appropriate key into the slot of the front door lock 78. The inner door 84 can be open with the same key which is inserted in the slot of the inner door lock 85. The housing 1' includes appropriate stops defining the partially open positions of the front and inner door, 2' and 84.

For loading of the newspapers, the front and inner doors 2' and 84 are completely open. After removing the non-sold newspapers, the change-over lever 120 is pivoted to a position "Fill", and the transporting plate 15' is displaced downwardly for receiving a new newspaper stack. After loading of the newspaper, the change-over lever 120 is shifted back to the position "Sell", and the transporting plate 15' is displaced upward until the top edge of the newspaper stack reaches the marked operational level. Then both inner and front doors 84 and 2' are closed. Upon closing of the front door 2', the connection bolt 81 is shifted into a leg of a horizontal retaining slot, whereby the lever 82 and the push element 88 are shifted into their rear, rest position.

In the "Fill" position of the change-over lever 120, the pawl 30', which cooperates with the stationary detent rod 20', engages the detent rod 20' with its upper edge (see FIG. 57) and prevents the transporting plate 15' from being displaced downward under the action of its release spring 116 for receiving a new stack of newspapers.

Figure 58:
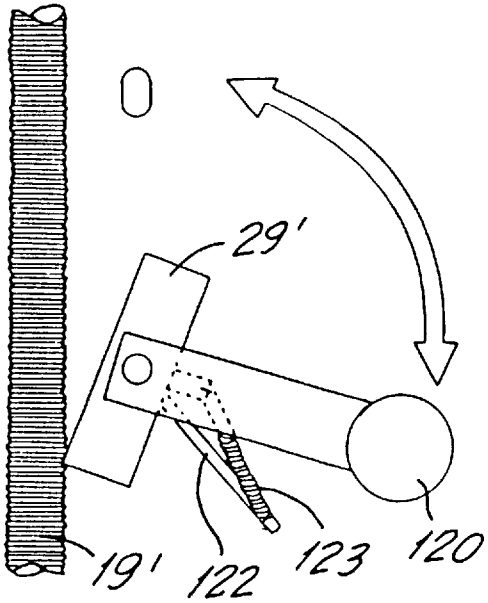
FIG. 58 is a view similar to that of FIG. 57, with the spacer pawl in its "Sell" position.
Figure 57:
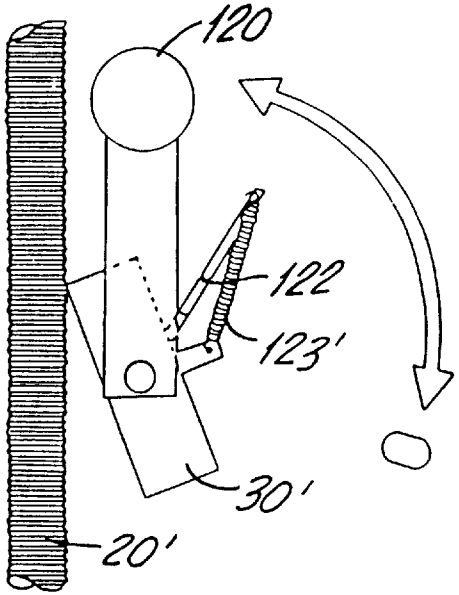
FIG. 57 is a schematic view showing an operating position of the spacer pawl engaging a stationary detent rod.
Figure 55:
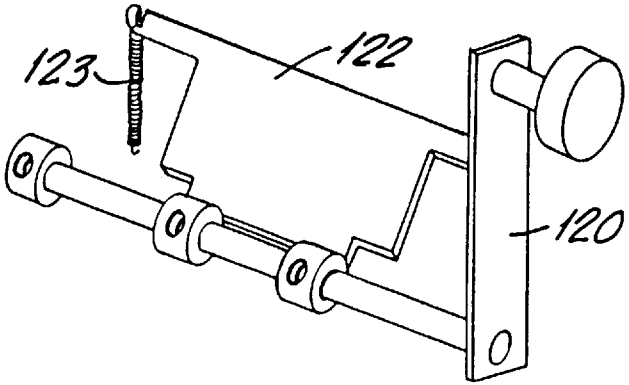
FIG. 55 is a perspective view of the change-over device of the machine shown in FIG. 32 for switching the spacer pawl from "Sell" to "Fill" positions.
Figure 56:
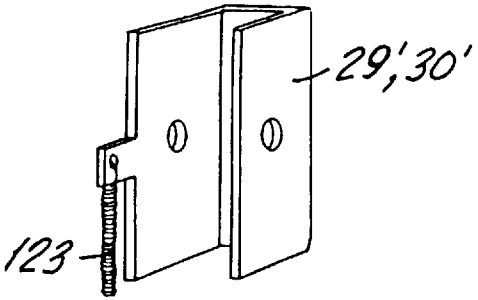
FIG. 56 is a perspective view of the spacer pawl.

In the "Sell" position, the pawl 29', which cooperates with the displaceable detent rod 19', engages the rod 19' with its lower edge (see FIG. 58). The pawl 30', which cooperates with the stationary detent rod 20', is also in this position. This arrangement of the detent paws 29' and 30' insures an upward displacement of the transporting plate 15' after selling of each newspaper. It should be pointed out that both pawls 29' and 30' have the same shape which is shown in FIG. 56.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A machine for vending printed products, comprising:

a housing for storing the printed products and having a printed product delivery slot;

an automatic coin mechanism associated with the housing for receiving payment for a printed product;

delivery means for delivery a paid-for printed product to the delivery slot, the delivery means including a transporting plate for supporting a stack of the printed products and a lift mechanism for lifting the transporting plate to a predetermined height by a predetermined amount corresponding to thickness of the paid-for printed product; and means cooperating with the lift mechanism for automatically adjusting the predetermined amount by which the transporting plate is lifted to the predetermined height;

wherein the lift mechanism comprises a displaceable detent rod and a first pawl associated with the transporting plate and cooperating with the displaceable detent rod for lifting the transporting plate, and wherein the means cooperating with the lift mechanism comprises a height regulator having an upper end thereof engaging a topmost printed product of a printed products stack and having a lower end thereof operationally connected with the displaceable detent rod, whereby the detent rod is lowered by an amount corresponding to an amount by which the height regulator is lowered as a result of a height loss caused by delivery of the top-most printed product and equal to thickness of the topmost printed product.

2. A machine according to claim 1, wherein a region of the transporting plate facing a front side of the housing is spaced from a housing bottom a distance smaller than a distance by which a region of the transporting plate facing a rear side of the housing is spaced from the housing bottom.

3. A machine according to claim 2, wherein the transporting plate is inclined to the housing at an angle of about 60°.

4. A machine according to claim 1, further comprising a support wall cooperating with the transporting plate for retaining the stack of printed products on the transporting plate and extending from the housing bottom parallel to and in a spaced relationship with respect to the front side.

5. A machine according to claim 1, further comprising an operating handle associated with the housing and cooperating with the transporting plate for lifting the stack of printed products so that a topmost printed product is located at an operational level at which the topmost printed product is transported to the delivery slot.

6. A machine according to claim 5, wherein the operating handle can be operated from outside upon actuation of the coin mechanism.

7. A machine according to claim 6, further comprising a push lever, which operationally connects the operating handle with the displaceable detent rod for lifting the transporting plate in response to operation of the operating handle.

8. A machine according to claim 7, wherein the lift mechanism comprises a stationary detent rod arranged adjacent to the displaceable detent rod for retaining the tranporting plate at the predetermined height, and a second pawl connecting the stationary detent rod with the transporting plate.

9. A machine according to claim 1, wherein the housing has a display window, in which next to be sold printed product is located and which is formed on a front side of the housing above the delivery slot.

10. A machine according to claim 9, wherein the display window has a rear wall on which a sign "Sold-Out becomes visible in absence of a printed product.

11. A machine according to claim 9, wherein the machine comprises an operating handle associated with the housing and operated in response to actuation of the coin mechanism, and a control bar cooperating with the operating handle, and wherein the display window includes upper and lower gates which are alternatively opened and closed by the operating handle and the control car.

12. A machine according to claim 9, wherein the delivery means includes at least one delivery push arm which brings a topmost printed product of the stack of printed products to one of the delivery slot and the display window provided above the delivery slot in which next-to-be-sold printed product is displayed.

13. A machine according to claim 12, wherein the push arm includes a delivery needle which engages, in an operational position of the push arm, the topmost printed product and which is withdrawn from the topmost printed product when the topmost printed product becomes disengaged from the upper end of the height regulator which engages the topmost newspaper in a non-operative condition of the machine.

14. A machine according to claim 13, wherein the height regulator is being lowered onto a next topmost printed product, after withdrawal of a previous topmost printed product by a distance corresponding to thickness of the printed product, and forms a delivery bridge in a direction toward the one of the delivery slot and the display window.

15. A machine according to claim 12, comprising an operational handle, associated with the housing, and a control bar associated with the operating handle for actuating the push arm.

* * * * *